United States Patent [19]

Kasuya et al.

[11] Patent Number: 4,974,849

[45] Date of Patent: Dec. 4, 1990

[54] BLOCK INLAYING PUZZLE

[75] Inventors: Kayoko Kasuya; Kazusato Kasuya, both of Kariya, Japan

[73] Assignee: Products Kasuya Inc., Aichi, Japan

[21] Appl. No.: 301,284

[22] Filed: Jan. 24, 1989

[30] Foreign Application Priority Data

May 12, 1988 [JP] Japan ..... 63-115707
Aug. 2, 1988 [JP] Japan ..... 63-102539[U]

[51] Int. Cl.[5] ..... A63F 3/00
[52] U.S. Cl. ..... 273/157 R; 446/118
[58] Field of Search ..... 273/157 R; 446/118

[56] References Cited

U.S. PATENT DOCUMENTS 3,695,615 10/1972 Shoptaugh ..... 273/157 R X
4,583,742 4/1986 Slinn ..... 273/157 R X
4,809,980 3/1989 Bertrand ..... 273/157 R

*Primary Examiner*—Edward M. Coven
*Assistant Examiner*—Raleigh W. Chin
*Attorney, Agent, or Firm*—Wegner & Bretschneider

[57] ABSTRACT

In a block inlaying puzzle, each of a plurality of blocks in a set has a plan configuration consisting of at least one basic shape. A puzzle board is provided with a block inlaying recess in which the set of blocks is inlaid. The block inlaying recess has a bottom surface and a peripheral wall surface surrounding a periphery of the bottom surface. The bottom surface has a configuration in which a plurality of the basic shapes are assembled together. A plurality of block guides arranged on the bottom surface of the block inlaying recess and/or marks applied to selected ones of the blocks impose as restrictions on inlaying of the set of blocks in the block inlaying recess.

2 Claims, 23 Drawing Sheets

BLOCK INLAYING PUZZLE

BACKGROUND OF THE INVENTION

The present invention relates to a block inlaying puzzle in which a set of a plurality of blocks each having a plan configuration consisting of at least one basic shape is inlaid in a block inlaying recess having a planar bottom surface whose configuration consists of a plurality of the basic shapes.

A block inlaying puzzle of the kind referred to above is known from, for example, Japanese Patent Publication No. 47-7497. The puzzle employs a set of twelve blocks which are identical in area with each other, but are different in plan configuration from each other. Each block has a plan configuration in which six basic shapes that are regular triangles are assembled together. The twelve blocks are inlaid, without gap, in a block inlaying recess having a planar bottom surface of a specific configuration. The puzzle is monotonous and lacks fun because a restriction imposed on inlaying of the blocks in the block inlaying recess is only the configuration of the bottom surface of the block inlaying recess. In other words, there is a problem that once the configuration of each block and the configuration of the bottom surface of the block inlaying recess are determined, the degree of difficulty of the puzzle is determined.

Furthermore, a so-called checkerboard puzzle is also known, which employs a set of blocks. A plurality of squares that are the basic shapes are assembled together to form the blocks into various plan configurations. The alternating squares are different in color from each other. When the set of blocks is inlaid in a block inlaying recess, a checkered pattern is formed. The checkerboard puzzle is generally high in degree of difficulty, because of such a restriction that the blocks must be inlaid in the block inlaying recess so as to form the checkered pattern. However, the degree of difficulty of the checkerboard puzzle is determined, once the configurations of the respective blocks, the configuration of the checkered pattern and the configuration of the bottom surface of the block inlaying recess are determined.

An easy puzzle pattern is suitable in the degree of difficulty for a beginner, but is not suitable for an expert. On the other hand, a difficult puzzle patter is suitable in the degree of difficulty for the expert, but is not suitable of the beginner. Further, there is also such a problem that even if a player finds out a puzzle pattern suitable for himself in the degree of difficulty, he will soon get used to the puzzle pattern so that the puzzle pattern becomes easy for him, because the degree of difficulty is maintained unchanged. Thus, the puzzle pattern becomes monotonous for the player so that he will be tired of the puzzle.

SUMMARY OF THE INVENTION

It is therefore an object of the invention to provide a block inlaying puzzle capable of variously changing patterns of blocks inlaid in a block inlaying recess in compliance with a degree of skill of a player.

According to the invention, there is provided a block inlaying puzzle comprising:

a set of a plurality of blocks each having a plan configuration consisting of at least one basic shape;

a puzzle board provided with a block inlaying recess having a bottom surface and a peripheral wall surface surrounding a periphery of the bottom surface, the bottom surface having a configuration in which a plurality of the basic shapes are assembled together; and restricting means arranged on the bottom surface of the block inlaying recess for imposing restrictions on inlaying of the set of blocks in the block inlaying recess.

According to the invention, there is also provided a block inlaying puzzle comprising:

a set of a plurality of blocks each having a plan configuration consisting of at least one basic shape;

a puzzle board provided with a block inlaying recess having a bottom surface and a peripheral wall surface surrounding a periphery of the bottom surface, the bottom surface having a configuration in which a plurality of the basic shapes are assembled together; and restricting means having a plurality of mark means applied respectively on at least front faces of selected ones of the set of blocks, for providing such a restriction that the set of blocks must be inlaid in the block inlaying recess in such a manner that the respective mark means on each pair of adjacent ones of the selected blocks are located adjacent to each other.

DETAILED DESCRIPTION

[First Embodiment: FIGS. 1 through 7]

Referring first to FIGS. 1 through 7, there is shown a puzzle according to a first embodiment of the invention. The puzzle employs a set of sixteen blocks 1*a* through 1*q* selected from blocks illustrated in FIG. 1*a*. Each of the blocks 1*a* through 1*l* has a plan configuration in which six regular triangles that are basic shapes are assembled together, and the blocks are different in plan configuration from each other. Each of the four kinds of blocks 1*m* through 1*q* has a plan configuration in which five basic regular triangles are assembled together, and the blocks are different in plan configuration from each other. As will be seen from FIG. 1*b*, each block 1 has both end faces which are formed respectively with peripheral steps 11 each for providing a clearance for block guides to be described later.

Figure 1B:
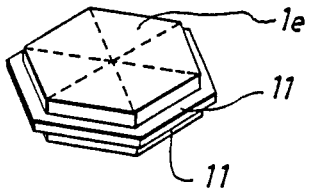
FIG. 1*b* is a perspective view of one of the various blocks illustrated in FIG. 1*a*.
Figure 1A:
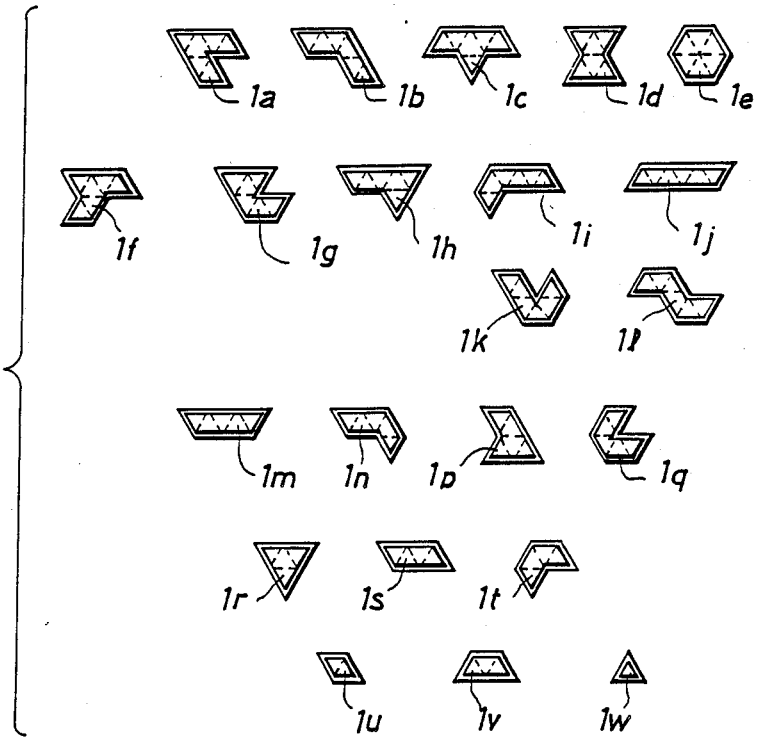
FIG. 1*a* is a plan view of various blocks capable of being used in a block inlaying puzzle according to a first embodiment of the invention.

Additionally, each of the blocks 1*r* through 1*t* illustrated in FIG. 1*a* has a plan configuration in which four basic regular triangles are assembled together. The block 1*v* has a plan configuration in which three basic regular triangles are assembled together. The block 1*w* has a plan configuration formed by a single basic regular triangle.

Figure 2:
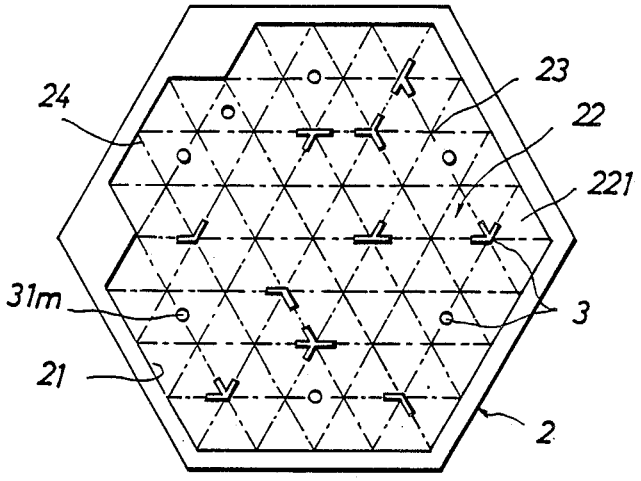
FIG. 2 is a plan view of a puzzle board provided with a block inlaying recess in which a set of selected ones of the blocks illustrated in FIG. 1*a* is inlaid.
Figure 3:
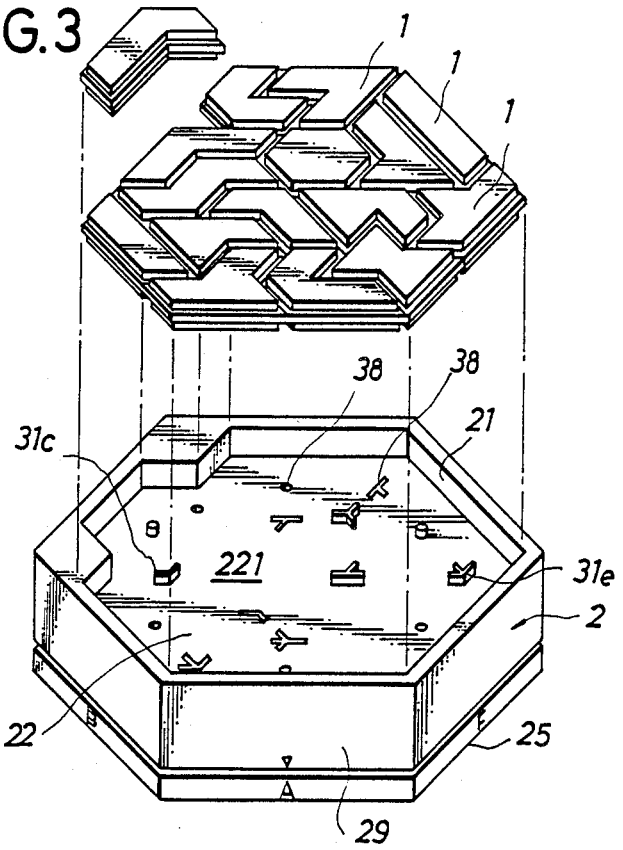
FIG. 3 is an exploded perspective view of a puzzle comprising the puzzle board illustrated in FIG. 2, a block-guide moving disc, and the set of blocks inlaid in the block inlaying recess in the puzzle board.
Figure 4:
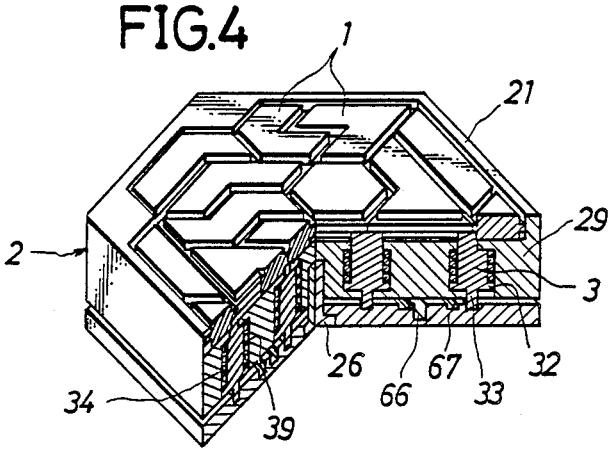
FIG. 4 is a cross-sectional perspective view of the block inlaying puzzle illustrated in FIG. 3.

The puzzle according to the first embodiment comprises a puzzle board 2 shown in FIGS. 2 and 3. The puzzle board 2 has one end face formed therein with a block inlaying recess 22 which has a planar bottom surface 221 and a peripheral wall surface 21 surrounding a periphery of the bottom surface 221. The bottom surface 221 has a plan configuration in which ninety-two regular triangles that are the basic shapes are assembled together. The puzzle board 2 has a peripheral surface which is in the form of a regular hexagon in plan. The bottom surface 221 of the block inlaying recess 22 is formed with a plurality of block guide bores 38 which are located respectively at apexes 23 of selected ones of the basic regular triangles forming the bottom surface 221 and at centers of sides 24 of selected ones of the basic regular triangles. As shown in FIG. 4, the puzzle board 2 has a bottom wall 29 which is formed therein with cylindrical bores 39 associated respective with the block guide bores 38 in communicating relation thereto.

Figure 6B:
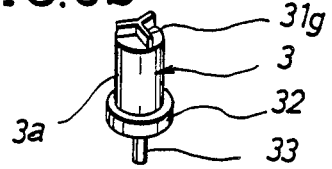
FIG. 6*b* is a perspective view of one of the block guide elements illustrated in FIG. 6*a;*

Selected ones of a plurality of block guide elements 3 shown in FIGS. 6*a* and 6*b* as well as block guide elements 3*m* shown in FIG. 9*a* to be described later are fitted respectively in the cylindrical bores 39 for movement along axes of the respective bores 39. Each block guide element 3 has a cylindrical body 3*a* whose top face is provided integrally with a block guide 31 composed of one or more ribs. The rib or ribs extend radially outwardly from the center of the top face of the cylindrical body 3*a* with an angle integer-times sixty degrees. The puzzle according to the first embodiment has incorporated therein the block guide elements 3 provided respectively with the block guides 31*c*, 31*e*, 31*f*, 31*g* and 31*h*. It is to be understood, however, that any suitable ones of the block guide elements 3 provided respectively with the block guides 31*a* through 31*k* may be incorporated in the puzzle board 2. A guide rod 33 extends from the lower end face of each cylindrical body 31 in coaxial relation thereto. The guide rod 33 has a forward end formed into a semispherical shape. A radial flange 32 is formed at the lower end of the cylindrical body 3*a* in integral relation thereto. A coil spring 34 is accommodated in each cylindrical bore 39 provided in the bottom wall 29 of the puzzle board 2. The coil spring 34 has a lower end which is abutted against an upper surface of the flange 32 on the cylindrical body 31, thereby biasing the block guide element 3 downwardly.

Figure 5:
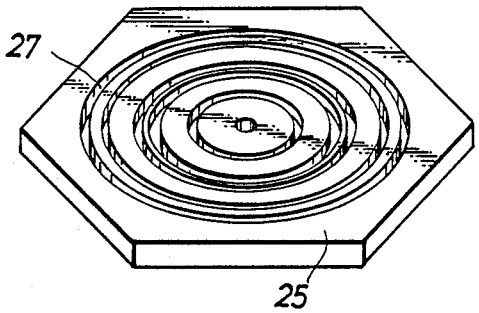
FIG. 5 is a perspective view of the block-guide moving disc illustrated in FIGS. 3 and 4.

As shown in FIG. 4, a shaft 26 is fixedly mounted to the center of the bottom wall 29 of the puzzle board 2. The shaft 26 has a forward end which projects downwardly from the end surface of the bottom wall 29. A block-guide moving disc 25 shown in FIG. 5 is mounted rotatably on the projecting end of the shaft 26, for moving the block guides 31 between a retracted position where some of the block guides 31 are retracted respectively into the block guide bores 38 and an extended position where some of the block guides 31 project from the bottom surface 221 of the block inlaying recess 22. Specifically, the block-guide moving disc 25 is formed with a plurality of circular cam grooves 27 arranged in concentric relation to each other about the shaft 26. Each cam groove 27 is provided with deep sections 66 and shallow sections 67 each of which has an angular extent of sixty degrees and which are arranged at random. The guide rods 33 of the respective block guide elements 3 are fitted in the cam grooves 27 for movement relative to the same and along the same. When the guide rod 33 of each block guide element 3 is abutted against any one of the deep sections 66 of a corresponding one of the cam grooves 27, the cylindrical body 3*a* is located adjacent the bottom of the cylindrical bore 39 under the biasing force of the coil spring 34, so that the block guide 31 is retracted into the guide bore 38 and is located at the retracted position. Accordingly, the block guide 31 does not project from the bottom surface 221 of the block inlaying recess 22. On the other hand, when the guide rod 33 is abutted against any one of the shallow sections 67 of the cam groove 27, the block guide 3 is pushed up against the biasing force of the coil spring 34, so that the block guide 31 comes out of the block guide bore 38 and projects from the bottom surface 221 of the block inlaying recess 22.

Figure 7:
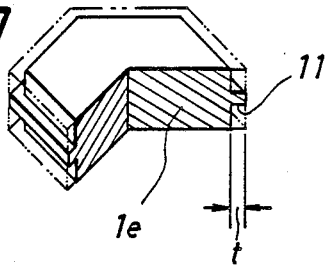
FIG. 7 is a cross-sectional perspective view of the block illustrated in FIG. 1*b*, for explanation of peripheral steps providing clearances for block guides of the block guide elements illustrated in FIG. 6*a;*

As shown in FIG. 7, each of the peripheral steps 11 of each block represented by the block 1*e* is formed by removal of a peripheral portion indicated by the double dotted lines, from the block body. Each step 11 has a depth t equal to the half of the thickness of the block guide 31. When the block guide 31 is moved to the extended position by the block-guide moving disc 25, the half of the thickness of the block guide 31 projects from the bottom surface 221 of the block inlaying recess 22. Accordingly, the depth t of the peripheral step 11 on the block 1 is determined to such a value as to receive the half of the thickness of the block guide 31 projecting from the bottom surface 221 of the block inlaying recess 22.

The operation of the puzzle constructed as above will be described below.

When the block-guide moving disc 25 is rotated about the shaft 26 by sixty degrees in an intermittent manner so that any one of the deep sections 66 of the cam grooves 27 is located at the guide rod 33 of any one of the block guide elements 3, the cylindrical body 3*a* of the block guide element 3 is pushed down toward the bottom of the cylindrical bore 39 under the biasing force of the coil spring 34, so that the block guide 31 is retracted into the block guide bore 38. Thus, the block guide 31 does not serve as a restriction at the time the blocks 1 are inlaid in the block inlaying recess 22 in the puzzle board 2.

On the other hand, when any one of the shallow sections 67 of the cam grooves 27 is located at the guide rod 33 of any one of the block guide elements 3, the shallow section 67 pushes the guide rod 33 upwardly. The block guide element 3 is moved upwardly against the biasing force of the coil spring 34, so that the block guide 31 projects from the bottom surface 221 of the block inlaying recess 22. Thus, the block guide 31 serves as a restriction at the time the blocks 1 are inlaid in the block inlaying recess 22 in the puzzle board 2. Since each cam groove 27 is provided with the deep and shallow sections 66 and 67 each of which has the angular extent of sixty degrees and which are arranged at random, some of the block guides 31 project from the bottom surface 221 of the recess 22 or some of the block guides 31 are retracted respectively into the block guide bores 38 at each time the block-guide moving disc 25 is rotated by sixty degrees. Thus, the block-guide moving disc 25 serves also as means for varying the number and/or arrangement pattern of the block guides 31 projecting from the bottom surface 221 of the block inlaying recess 22. The more the number of the block guides 31 projecting from the bottom surface 221 of the block inlaying recess 22, the more it becomes difficult to inlay the blocks 1 in the block inlaying recess 22. On the other hand, the less the number of the block guides 31 projecting from the bottom surface 221 of the block inlaying recess 22, the more it is made easy to inlay the blocks 1 in the block inlaying recess 22. In this manner, it is possible to provide the puzzle with six degrees of difficulty.

The puzzle according to the first embodiment employs the set of blocks 1 which are different in configuration from each other. However, there can be obtained the same advantages even if the set of blocks includes a few blocks identical in configuration with each other.

[Modifications of First Embodiment: FIGS. 8*a* through 8*k*]

FIGS. 8*a* through 8*k* show respectively various modifications of the block inlaying recess in the puzzle board.

Figure 8A:
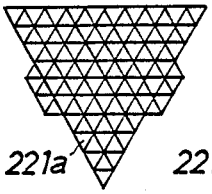
FIGS. 8*a* through 8*k* are views similar to FIG. 2, but showing various modifications of the block inlaying recess.
Figure 8B:
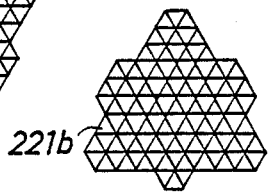
Figure 8C:
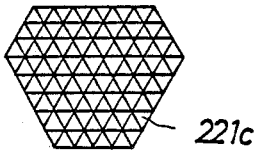
Figure 8D:
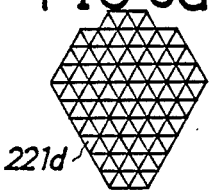
Figure 8E:
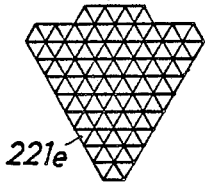
Figure 8F:
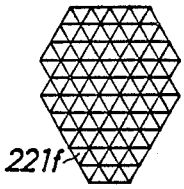
Figure 8G:
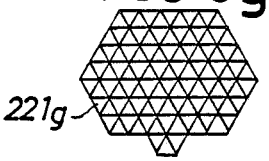
Figure 8H:
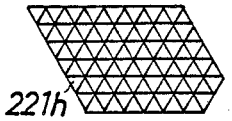
Figure 8I:
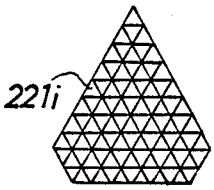
Figure 8J:
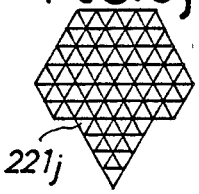
Figure 8K:
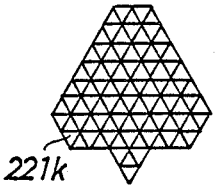

Each of bottom surfaces 221*a* through 221*c* of block inlaying recesses shown respectively in FIGS. 8*a* through 8*c* has a configuration in which one hundred and ten regular triangles that are the basic shape are assembled together. A set of twenty-one blocks 1*a* through 1*v* shown in FIG. 1*a* is adapted to be inlaid in the block inlaying recess. Each of bottom surfaces 221*d* through 221*g* of block inlaying recesses shown respectively in FIGS. 8*d* through 8*g* has a configuration in which one hundred and four regular triangles that are the basic shapes are assembled together. A set of nineteen blocks 1*a* through 1*t* shown in FIG. 1*a* is adapted to be inlaid in the block inlaying recess. Each of bottom surfaces 221*h* through 221*k* of block inlaying recesses shown respectively in FIGS. 8*h* through 8*k* has a configuration in which ninety-two regular triangles that are the basic shapes are assembled together. A set of sixteen blocks 1*a* through 1*q* shown in FIG. 1*a* is adapted to be inlaid in the block inlaying recess.

In each of the modifications shown respectively in FIGS. 8*a* through 8*k*, means for moving the block guides between the retracted position and the extended position is not shown. However, the moving means can be formed by the intermittently rotatable block-guide moving disc 25 mounted to the lower side of the puzzle board 2 as shown in FIG. 4.

Moreover, the configuration of each block guide is not shown in FIGS. 8*a* through 8*k*. However, the block guides 31*a* through 31*k* shown in FIG. 6*a* and/or the block guides 31*m* and 31*n* shown respectively in FIGS. 9*a* and 9*b* to be described later can be so arranged as to be movable between the extended position where the block guides project from the bottom surface 221 of the block inlaying recess and the retracted position where the block guide are retracted respectively into the block guide bores.

In each of the modifications shown respectively in FIGS. 8*a* through 8*k*, the bottom surface of the block inlaying recess is different in configuration from the bottom surface 221 of the block inlaying recess 22 in the first embodiment and, in addition thereto, a set of blocks inlaid in the block inlaying recess is different in configuration from that used in the first embodiment. It will be seen, however, that each modification has such advantages that the block guides serve as restrictions at the time the blocks are inlaid in the block inlaying recess 221, similarly to the first embodiment.

[Modifications of First Embodiment: FIGS. 9*a* through 9*f*]

FIGS. 9*a* through 9*f* respectively show another modifications of the block guide elements and the blocks 1. The blocks 1 will be described on behalf of a configuration corresponding to the block 1*e* shown in FIG. 1*b*.

Figure 9A:
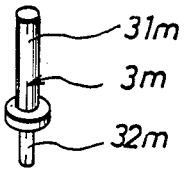
FIG. 9*a* is a view similar to FIG. 6*b*, but showing a modification of the block guide.
Figure 9B:
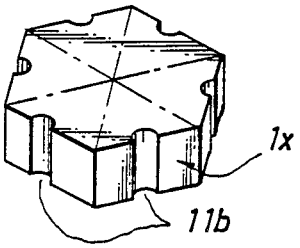
FIG. 9*b* is a view similar to FIG. 1*b*, but showing a modification of a block used together with the block guide illustrated in FIG. 9*a;*

A block guide 31*m* of a block guide element 3*m* shown in FIG. 9*a* is in the form of a column having a circular cross-section. The block guide 31*m* is so designed as to be moved between the extended position and the retracted position, at a location on the bottom surface 221 of the block inlaying recess 22 which corresponds to a center of a side of the basic regular triangle. A set of blocks used together with the block guide 31*m* may include the blocks 1*a* through 1*w* shown in FIG. 1*a*, or may include a block 1*x* shown in FIG. 9*b*. Grooves 11*b* each having a semi-circular cross-sectional shape are formed respectively at centers of respective six sides of the block 1*x*.

Figure 9C:
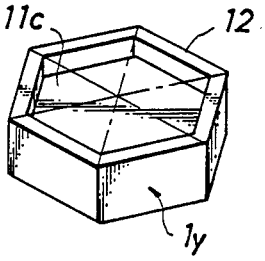
FIG. 9*c* is a view similar to FIG. 1*b*, but showing another modification of a block used together with the block guide illustrated in FIG. 9*a;*

If the block guide element 3*m* is arranged at the center of the adjoining sides of each pair of adjacent basic regular triangles, the block 1*y* shown in FIG. 9*c* is employed. The block 1*y* is provided with a projecting peripheral wall 12 extending along an outer peripheral edge of the block 1*y*. The projecting peripheral wall 12 defines a recess 11*c* serving as a clearance for the block guide 31*m*. If the block 1*y* is used, there is provided such a restriction that a set of blocks including the block 1*y* must be inlaid in the block inlaying recess in the puzzle board in such a manner that one or more block guides including the block guide 31*m*, which are in the extended position, are received in the recess 11*c* in each of some of the blocks including the block 1*y*.

Figure 9D:
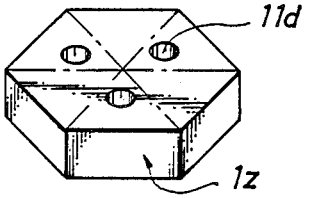
FIG. 9*d* is a view similar to FIG. 1*b*, but showing still another modification of a block used together with the block guide illustrated in FIG. 9*a;*

Bores 11*d* circular in cross-section are formed respectively at centers of some of the basic regular triangles which form the block 1*z* shown in FIG. 9*d*. If a set of blocks including the block 1*z* is used, the block guide elements 3*m* each provided with the columnar block guides 31*m* are arranged respectively in the vicinities of the centers of some of the basic regular triangles which form the bottom surface of the block inlaying recess. Thus, there is provided such a restriction that a set of blocks including the block 1*z* must be inlaid in the block inlaying recess in such a manner that the block guides including the block guide 31*m*, which are in the extended position, are fitted respectively in the bores 11*d*.

Figure 9E:
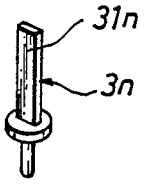
FIG. 9*e* is a view similar to FIG. 6*b*, but showing another modification of the block guide.
Figure 9F:
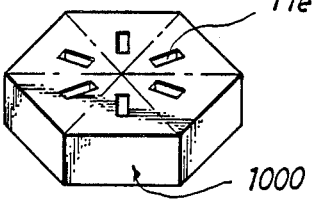
FIG. 9*f* is a view similar to FIG. 1*b*, but showing a modification of a block used together with the block guide illustrated in FIG. 9*e;*

The block guide 31*n* of the block guide element 3*n* shown in FIG. 9*e* is rectangular in cross-section. One of a set of blocks 1000 used together with the block guides including the block guide 31*n* is shown in FIG. 9*f*. Bores 11*e* each having a rectangular cross-sectional shape are formed respectively at centers of basic regular triangles which form the plan configuration of the block 1000. In this case, accordingly, there is provided such a restriction that the set of blocks including the block 1000 must be inlaid in the block inlaying recess in such a manner that the block guides including the block guide 31*n*, which are in the extended position, are fitted respectively in the bores 11*e*.

The bottom surface of the block inlaying recess 22 in the puzzle board 2, in which a set of blocks including any one of the blocks 1*x* through 1*z* and the block 1000 are inlaid, may have the configuration shown in FIG. 2, or may have any one of the bottom surfaces 221*a* through 221*k* of the respective block inlaying recesses shown respectively in FIGS. 8*a* through 8*k*.

In the modifications illustrated in FIGS. 9*a* through 9*f*, means for moving the block guides 31 between the extended position and the retracted position can be formed by the intermittently rotatable block-guide moving disc 25 mounted to the lower side of the puzzle board 2 as shown in FIG. 4.

The modifications shown in FIGS. 9*a* through 9*f* have advantages similar to those of the previously described first embodiment. That is, there is provided such a restriction that the set of blocks must be inlaid in the block inlaying recess in such a manner that the block guides 31 in the extended position are fitted in the grooves 11*b*, the recesses 11*c* or the bores 11*d* or 11*e*.

[Second Embodiment: FIGS. 10*a* through 11*c*]

Referring to FIGS. 10*a* through 11*c*, there is shown a puzzle according to a second embodiment of the invention.

Figure 10A:
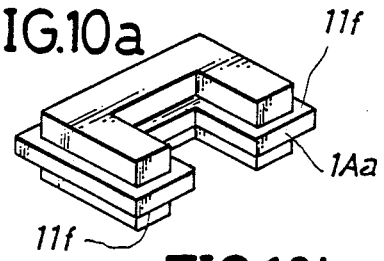
FIG. 10*a* is a perspective view of one of various blocks capable of being employed in a second embodiment of the invention.
Figure 10B:
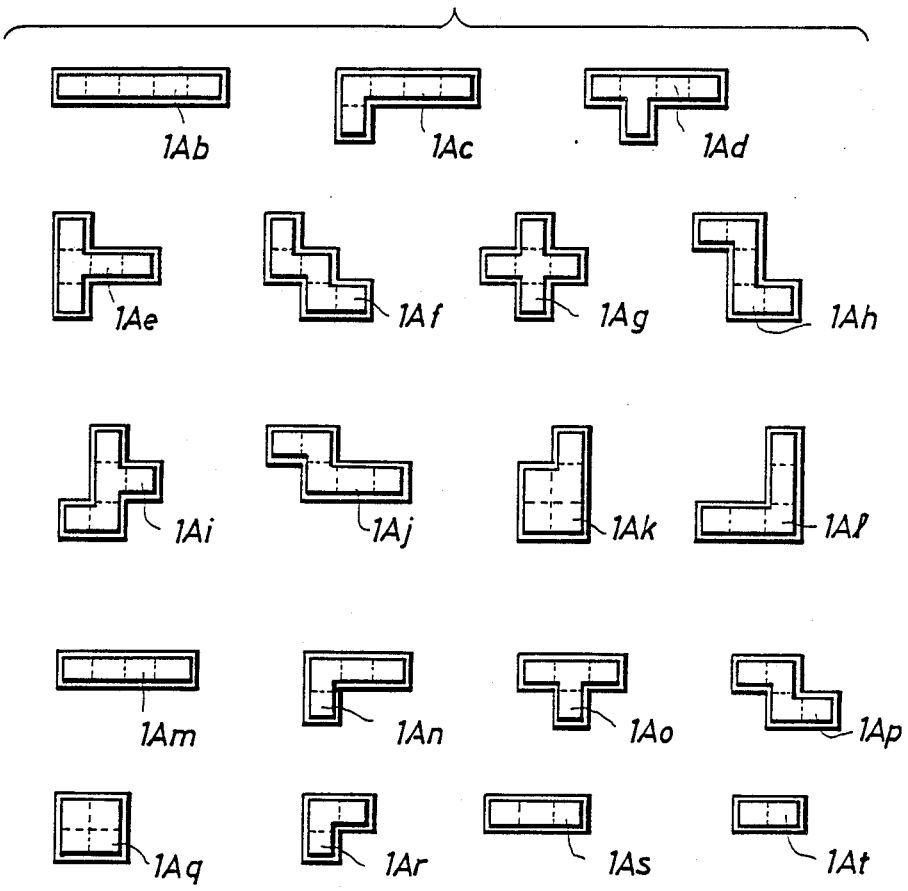
FIG. 10*b* is a plan view of the remaining blocks capable of being utilized in the second embodiment.

As shown in FIGS. 10*a* and 10*b*, each of blocks 1Aa through 1At is formed in such a manner that two through five regular triangles that are the basic shapes are assembled together. As shown in FIG. 10*a*, each block has opposite end faces which are provided respectively with peripheral steps 11*f*, like the blocks shown in FIGS. 1*a* and 1*b*. A set of selected ones of the blocks 1Aa through 1At is adapted to be inlaid in a block inlaying recess 221 shown in FIG. 11*a*. Alternatively, a set of selected ones of the blocks 1Aa through 1At can be inlaid in each of block inlaying recesses 22*m* and 22*n* shown respectively in FIGS. 11*b* and 11*c*. Each of bottom surfaces of the respective block inlaying recesses 22*l* and 22*m* shown respectively in FIGS. 11*a* and 11*b* has a configuration in which eighty-eight squares that are the basic shapes are assembled together. Twenty blocks 1Aa through 1As shown in FIGS. 10*a* and 10*b* can be inlaid in each of the block inlaying recesses 22*l* and 22*m*. A bottom surface of the block inlaying recess 22*n* shown in FIG. 11*c* has a configuration in which eighty squares that are the basic shapes are assembled together. A set of seventeen blocks 1Aa through 1Ap shown in FIGS. 10*a* and 10*b* can be inlaid in the block inlaying recess 22*n*. The block guides 31*p* through 30*t* are received in the peripheral steps 11*f* formed in the blocks.

Figure 11A:
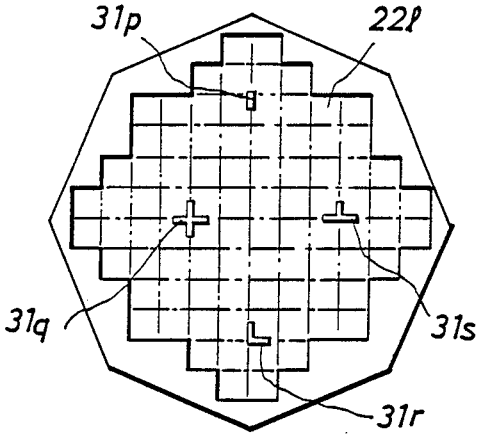
FIG. 11*a* is a plan view of a puzzle board provided with a block inlaying recess in which a set of selected ones of the blocks illustrated in FIG. 10*a* is inlaid.
Figure 11B:
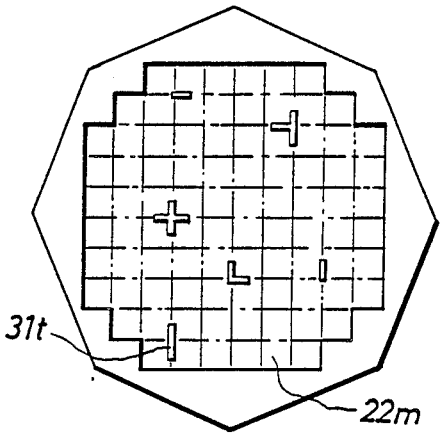
FIGS. 11*b* and 11*c* are views similar to FIG. 11*a*, but respectively showing another modifications of the block inlaying recess.
Figure 11C:
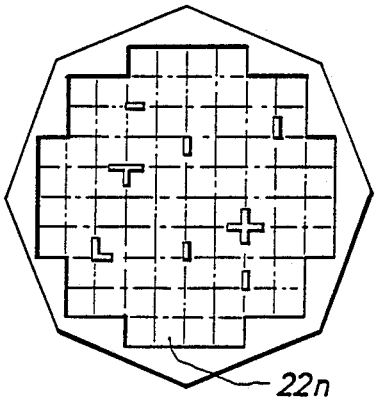

The block guides 31*p* through 31*t* shown in FIGS. 11*a* through 11*c* are different in angle of the ribs from those described previously with reference to FIG. 6*a*. That is, one or more ribs forming each of the block guides 31*p* through 31*t* are arranged with an angle integer-times ninety degrees.

In the second embodiment illustrated in FIGS. 10*a* through 11*c*, means for moving the block guides 31*p* through 31*t* between the extended position and the retracted position can be formed by the intermittently rotatable block-guide moving disc 25 which is mounted to the lower side of the puzzle board 2 as shown in FIG. 4. In the second embodiment, however, each cam groove 27 is provided with deep and shallow sections 66 and 67 each of which extends through an angular extent of forty-five degrees and which are arranged at random.

The second embodiment has advantages similar to those of the previously described first embodiment. That is, there is provided such a restriction that the blocks must be inlaid in the block inlaying recess in such a manner that the peripheral steps 11*f* in the blocks are located at some or all of the block guides 31*p* through 31*t*, which are in the extended position.

In the second embodiment, the basic shape forming the blocks is not limited to the square, but the block inlaying puzzle similar to that of the first embodiment can be obtained even if the basic shape of the blocks is rectangular.

Figure 13:
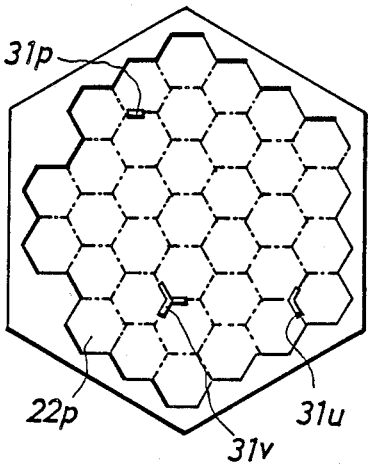
FIG. 13 is a plan view of a puzzle board formed therein with a block inlaying recess in which a set of selected ones of the various blocks illustrated in FIG. 12*a* is inlaid.

[Third Embodiment: FIGS. 12*a* through 13]

Figure 12B:
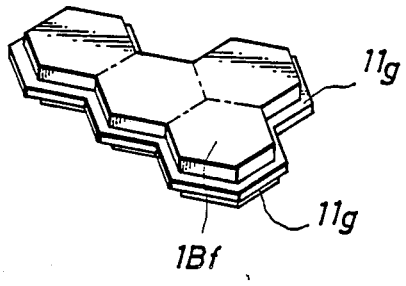
FIG. 12*b* is a perspective view of one of the blocks illustrated in FIG. 12*a;*
Figure 12A:
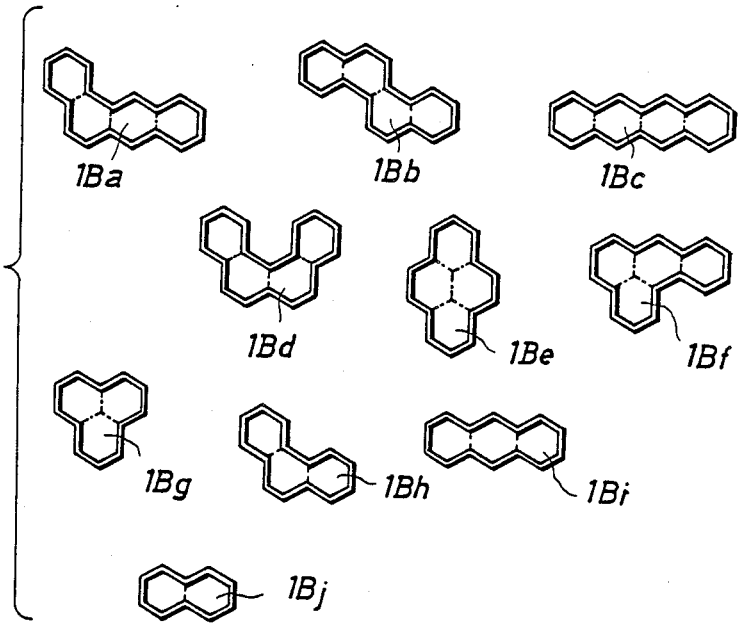
FIG. 12*a* is a plan view of various blocks capable of being employed in a block inlaying puzzle according to a third embodiment of the invention.

Referring to FIGS. 12*a* through 13, there is shown a puzzle according to a third embodiment of the invention. As shown in FIG. 13, a bottom surface of a block inlaying recess 22*p* has a configuration in which thirty-five regular hexagons that are the basic shapes are assembled together. Inlaid in the block inlaying recess 22*p* is a set of ten blocks 1Ba through 1Bj shown in FIGS. 12*a* and 12*b*. Each of the blocks 1Ba through 1Bf has a configuration in which four basic regular hexagons are assembled together. Each of the blocks 1Bg through 1Bi has a configuration in which three basic regular hexagons are assembled together. The block 1Bj has a configuration in which two basic regular hexagons are assembled together.

Figure 6A:
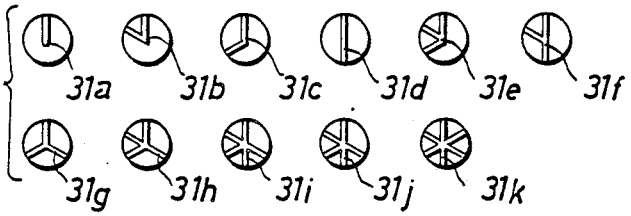
FIG. 6*a* is a plan view of various block guide elements illustrated in FIG. 3.

Of block guides 31*p*, 31*u* and 31*v* shown in FIG. 13, the block guides 31*u* and 31*v* are different in angle of the ribs from those shown in FIG. 6*a*. That is, the ribs forming each of the block guides 31*u* and 31*v* are formed on the block guide element with an angle integer-times one hundred and twenty degrees.

In the third embodiment, means for moving the block guides 31*p*, 31*u* and 31*v* between the extended position and the retracted position can be formed by the intermittently rotatable block-guide moving disc 25 which is mounted to the lower side of the puzzle board 2 as shown in FIG. 4.

The third embodiment has advantages similar to those of the previously described first embodiment. That is, there is provided such a restriction that the set of blocks must be inlaid in the block inlaying recess 22*p* in such a manner that the peripheral steps 11*g* on the blocks are located at the block guides 31*p*, 31*u* and 31*v* which are in the extended position.

Figure 14:
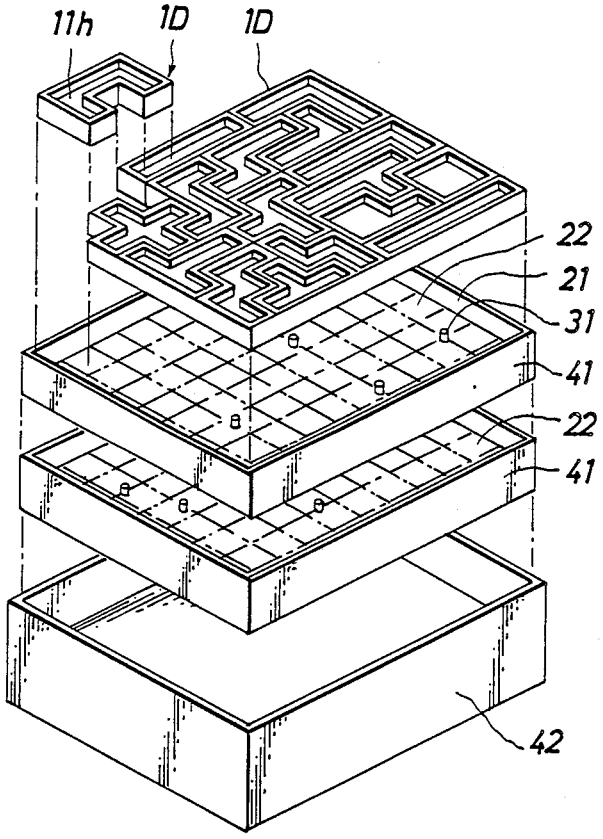
FIG. 14 is an exploded perspective view of a block inlaying puzzle according to a fourth embodiment of the invention, which has a plurality of replaceable puzzle boards.
Figure 15:
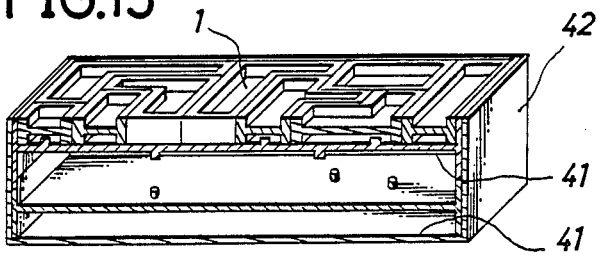
FIG. 15 is a cross-sectional perspective view of the puzzle illustrated in FIG. 14.

[Fourth Embodiment: FIGS. 14 and 15]

Referring to FIGS. 14 and 15, there is shown a puzzle according to a fourth embodiment of the invention. The fourth embodiment has another means for varying the number and/or arrangement pattern of the block guides projecting from the bottom surface of the block inlaying recess.

The puzzle illustrated in FIG. 14 comprises a two puzzle boards 41 each of which has opposite end faces provided respectively with block inlaying recesses 22. A bottom surface of each of the block inlaying recesses 22 has a configuration in which eighty squares that are the basic shapes are assembled together. Block guides 31 are fixedly mounted to the bottom surface of the block inlaying recess 22 at locations each corresponding to the center of the side of the basic square. The two puzzle boards 41 are accommodated in a case 42 in a superimposed fashion. A set of blocks 1D are the same in outer configuration as the blocks 1Aa through 1Ap shown in FIG. 10*a*. However, each block has opposite end faces formed respectively with recesses 11*h*, in place of the peripheral steps 11.

A player plays the puzzle in such a manner that the set of blocks 1D are inlaid in the block inlaying recess 22 in the upper surface of the uppermost puzzle board 41.

The fourth embodiment has also advantages similar to those of the previously described first embodiment. That is, there is provided such a restriction that the set of blocks 1D must be inlaid in the block inlaying recess 22 in such a manner that the recesses 11*h* in some of the blocks 1D are located at the projecting block guides 31.

As described above, the means for varying the number and/or arrangement pattern of the projecting block guides 31 may be formed by the plurality of puzzle boards 41 accommodated in the case 42 wherein a plurality of block guides 31 are fixedly mounted to the bottom surface of each block inlaying recess 22 so as to project from the bottom surface.

Figure 16:
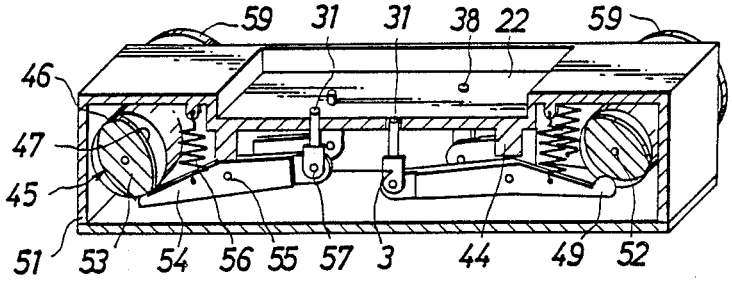
FIG. 16 is a cross-sectional perspective view showing a fifth embodiment of the invention, which employs a pair of drums in place of the block-guide moving disc illustrated in FIGS. 4 and 5.

[Fifth Embodiment: FIG. 16]

FIG. 16 shows a puzzle according to a fifth embodiment of the invention, which comprises another means for varying the number and/or arrangement pattern of block guides 31 projecting from the bottom surface of the block inlaying recess 22. The block inlaying recess 22 is formed in an outer surface of a top wall of a case 51 which serves as a puzzle board. A pair of drums 53 are arranged within the case 51 in parallel relation to each other. The drums 53 are mounted respectively on drum shafts 52 for rotation therewith. Each drum shaft 52 extends through a side wall of the case 51 and projects outwardly. A dial 59 is mounted on the projecting end of the drum shaft 52 for rotation therewith. A plurality of levers 54 are associated with each of the drums 53. Each lever 54 is supported at its center by a pivot 55 for angular movement thereabout. The pivot 55 is mounted to a support projection 44 formed integrally on an inner surface of the top wall of the case 51. The lever 54 has one end adjacent the drum 53, which is formed with an arcuate lever projection 49. The lever projection 49 is abutted against a bottom of a corresponding one of circumferential cam grooves 45 which are provided in the drum 53. The cam grooves 45 are spaced from each other along an axis of the drum 53. Each cam groove 45 is formed with a shallow section 46 and a deep section 47 each of which extends over an angular extent of 180 degrees. The lever 54 has the other end to which one of the block guide elements 3 is mounted through a pivot 57 for pivotal movement thereabout. The block guide member 3 has a block guide 31 which is fitted in a corresponding one of a plurality of block guide bores 38 formed in the bottom surface of the block inlaying recess 22. A coil spring 56 is arranged between the inner surface of the top wall of the cover 51 and each of the levers 54, for abutting the lever projection 49 against the bottom of the corresponding cam groove 45.

A set of blocks inlaid in the block inlaying recess 22 shown in FIG. 16 may consist of blocks illustrated in FIG. 10*a* or 14, or may include the blocks formed therein with bores each having a circular or rectangular cross-sectional shape as illustrated in FIG. 9*d* or 9*f*.

The operation of the fifth embodiment shown in FIG. 16 will next be described. When the pair of dials 59 are turned, the drums 53 are rotated about respective axes of the drum shafts 52 together therewith. When the lever projection 49 on each lever 54 is abutted against the shallow section 46 of a corresponding one of the cam grooves 45, the lever 54 is moved angularly about the pivot 55 against the biasing force of the lever spring 56, so that the block guide 31 associated with the other end of the lever 54 projects from the bottom surface of the block inlaying recess 22. Accordingly, the block guide 31 serves as a restriction at the time the blocks are inlaid in the block inlaying recess 22. On the other hand, when the dials 59 are further turned so that the lever projection 49 is abutted against the deep section 47 of the cam groove 45, the lever 54 is moved angularly about the pivot 55 under the biasing force of the lever spring 56 so that the block guide 31 is retracted into the block guide bore 38. Accordingly, the block guide 31 does not serve as a restriction at the time the blocks are inlaid in the block inlaying recess 22. In this manner, turning of the dials 59 causes the block guides 31 to be moved between the extended position where some of the block guides 31 project from the bottom surface of the block inlaying recess 22 and the retracted position where some of the block guides 31 are retracted respectively into the block guide bores 38. Thus, since it is possible to vary the restricting conditions at the time the blocks are inlaid in the block inlaying recess 22, it is possible to vary the degree of block-inlaying difficulty. In this connection, it is preferable that marks representative of the degree of block-inlaying difficulty are applied to each of the dials 59, and one of the marks on the dial 59 is set to a corresponding one of a pair of reference marks on the case 51.

The fifth embodiment illustrated in FIG. 16 has advantages similar to those of the previously described first embodiment. That is, there is provided such a restriction that the set of blocks must be inlaid in the block inlaying recess 22 in such a manner that the peripheral steps on the blocks, the recesses in the blocks or the bores in the blocks are located at the projecting block guides 31.

Figure 17:
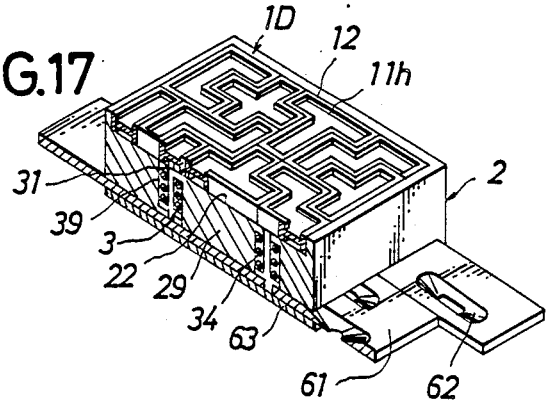
FIG. 17 is a cross-sectional perspective view showing a sixth embodiment of the invention, which employs a plurality of slidable block-guide moving plates in place of the block-guide moving disc illustrated in FIGS. 4 and 5.

[Sixth Embodiment: FIG. 17]

FIG. 17 shows a puzzle according to a sixth embodiment of the invention, which employs a set of blocks 1D whose basic shape is square as shown in FIG. 14. Each block 1 is provided with a projecting wall 12 extending along the outer periphery of the block. The projecting wall 12 defines a recess 11*h*. A bottom surface of the block inlaying recess 22 has a configuration in which eighty squares consisting of eight by ten, that are the basic shapes, are assembled together.

A plurality of block guide elements 3 are accommodated respectively in cylindrical bores 39 formed in the bottom wall 29 of the puzzle board 2. Each block guide element 3 is biased downwardly by a corresponding one of coil springs 34. The block guide element 3 has a configuration shown in FIG. 9*a*.

A plurality of block-guide moving plates 61 are arranged between the lower surface of the bottom wall 29 of the puzzle board 2 and a bottom plate 63 for laterally sliding movement relative to the puzzle board 2. A plurality of guide bores 62 are formed in each of the block-guide moving plates 61. Each guide bore 62 is so tapered as to diverge upwardly. When any one of the guide rods 33 of the respective block guide elements 3 is aligned with the guide bore 62, the block guide element 3 is moved to the retracted position under the biasing force of the coil spring 34.

The operation of the sixth embodiment will be described.

When the block-guide moving plates 61 are moved laterally so that the guide rods 33 of some of the block guide elements 3 are aligned respectively with the axes of some of the guide bores 62, the some block guide elements 3 are moved downwardly under the biasing forces of the respective coil springs 34 so that the block guides 31 are moved to the retracted position below the bottom surface of the block inlaying recess 22. Thus, the block guides 31 do not serve as restrictions at the time the set of blocks 1D are inlaid in the block inlaying recess 22.

When the block-guide moving plates 61 are further moved so that the guide rods 33 of some of the block guide elements 3 are brought out of alignment with the axes of some of the guide bores 62, the some block guide elements 3 are pushed upwardly by the block-guide moving plates 61. Thus, the block guides 31 project from the bottom surface of the block inlaying recess 22 against the biasing forces of the respective coil springs 34. The block guides 31 serve as restrictions at the time the set of the blocks 1D is inlaid in the block inlaying recess 22.

The sixth embodiment has advantages similar to those of the previously mentioned first embodiment. That is, there is provided such a restriction that the blocks 1D must be inlaid in the block inlaying recess 22 in such a manner that the recesses **11*h* in the blocks 1D are located at the block guides 31** which are in the extended position.

Figure 18:
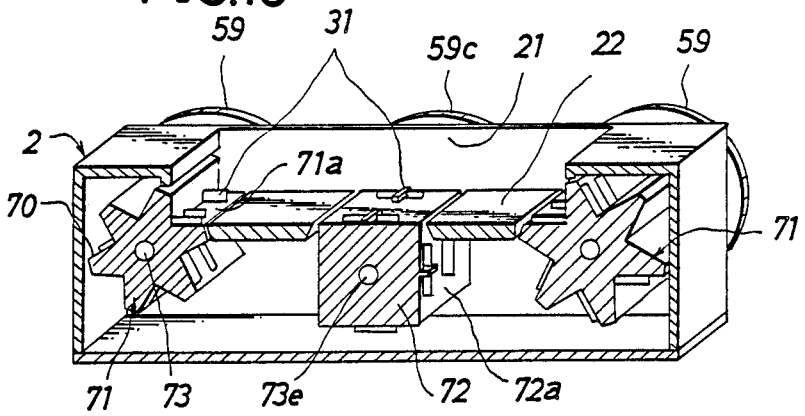
FIG. 18 is a cross-sectional perspective view showing a seventh embodiment of the invention, which employs three rotary guide members in place of the block-guide moving disc illustrated in FIGS. 4 and 5.

[Seventh Embodiment: FIG. 18]

FIG. 18 shows a puzzle according to a seventh embodiment of the invention, which comprises another means for varying the number and arrangement pattern of block guides 31 projecting from the bottom surface of the block inlaying recess 22.

A set of blocks used in the seventh embodiment consists of seventeen blocks 1Aa through 1Ag illustrated in FIGS. **10*a* and 10*b*, whose basic shape is square. Each block has opposite end faces provided respectively with peripheral steps 11*f*. The bottom surface of the block inlaying recess 22** has a configuration in which eighty squares consisting of eight by ten, that are the basic shapes, are assembled together.

A pair of outward rotary guide members 71 form parts of a peripheral wall surface 21 of the block inlaying recess 22 and parts of the bottom surface thereof. A pair of dials 59 are connected respectively to the outward rotary guide members 71 through respective rotary shafts 73 for rotation therewith. Each dial 59 and a corresponding one of the outward rotary guide member 71 are mounted rotatably to the puzzle board 2. A bottom rotary guide member 72 is mounted to the puzzle board 2 through a rotary shaft 73 for rotation relative to the puzzle board 2. A dial **59*c* is fixedly connected to the bottom rotary guide member 72 through a rotary shaft 73. Each outward rotary guide member 71 is provided with six radial projections 70 each of which has a side face 71*a* forming a part of the bottom surface of the block inlaying recess 22. The bottom rotary guide member 72 is provided with four side faces 72*a* each of which forms a part of the bottom surface of the block inlaying recess 22. One or more block guides 31 having various configurations are mounted to each side face 71*a*, 72*a*** at locations corresponding respectively to sides of some of the basic squares.

The operation of the seventh embodiment constructed as above and shown in FIG. 18 will be described. The dials 59 and **59*c* are rotated whereby the outward rotary guide members 71 and the bottom rotary guide member 72 are rotated, so that the block inlaying recess 22 is formed by the side faces 71*a* and 72*a* which are different in configuration from each other. Thus, rotation of the dials 59 and 59*c* causes the number and arrangement pattern of the block guides 31 on the side faces 71*a* and 72 to be varied to thereby vary the restricting conditions at the time the set of blocks is inlaid in the block inlaying recess 22**.

As described above, the seventh embodiment also has advantages similar to those of the previously described first embodiment.

Figure 19:
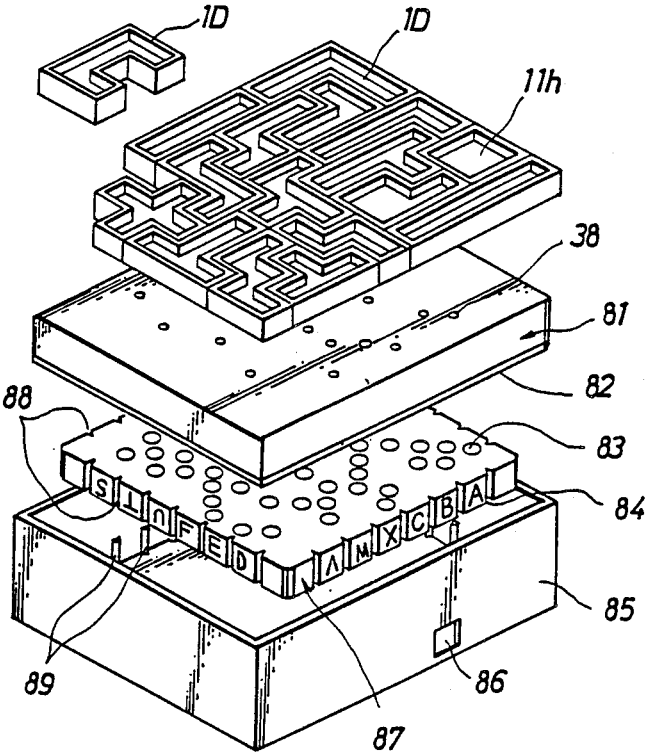
FIG. 19 is an exploded perspective view of a puzzle according to an eighth embodiment of the invention, which comprises a control disc provided with control bores in which guide rods of selected ones of a plurality of block guide elements can be fitted respectively.
Figure 20:
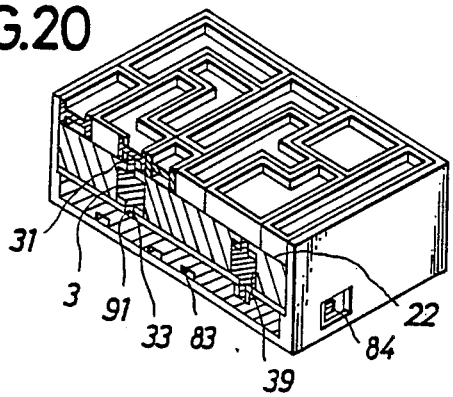
FIG. 20 is a cross-sectional perspective view of the puzzle illustrated in FIG. 19.

[Eighth Embodiment: FIGS. 19 and 20]

FIGS. 19 and 20 show a puzzle according to an eighth embodiment of the invention, which comprises another means for varying the number and/or arrangement pattern of block guides 31 projecting from the bottom surface of the block inlaying recess.

A control disc 87, a block guide assembly 81 and a set of blocks 1D are accommodated in a case 85 in the mentioned order in a superimposed manner. The case 85 and the block guide assembly 81 serve as a puzzle board such that a peripheral wall of the case 85 and a top face of the block guide assembly 81 cooperate with each other to define the block inlaying recess 22. The bottom surface of the block inlaying recess 22, which is formed by the top face of the block guide assembly 81, has a configuration in which eighty squares consisting of eight by ten, that are the basic shapes, are assembled together. The blocks 1D are the same in configuration as those shown in FIG. 14, and each block has a configuration in which the four or five basic squares are assembled together.

The control disc 87 has a plan configuration in which sixty-four basic squares consisting of eight by eight are assembled together. The control disc 87 has four side faces each of which is formed with a plurality of positioning grooves 88 spaced from each other at a pitch equal to the length of a side of the basic square. On the other hand, the peripheral wall of the case 85 has an inner surface which is formed with a plurality of positioning projections 89 spaced from each other at a pitch equal to that of the positioning grooves 88. The positioning projections 89 are fitted in the positioning grooves 88 so that the control disc 87 can be positioned with respect to the case 85.

A difficulty degree mark 84 indicative of the degree of difficulty of the puzzle is printed on a portion of the side faces of the control disc 87 between each pair of adjacent positioning grooves 88. On the other hand, the peripheral wall of the case 85 is provided with a window 86 such that one of the difficulty degree marks 84 printed on the side faces of the control disc 87 can be viewed through the window 86.

The top face of the block guide assembly 81 is formed with a plurality of block guide bores 38 whose positions correspond respectively to the centers of the sides of some of the basic squares. The block guide assembly 81 is provided with cylindrical bores 39 below the respective block guide bores 38 in communicating relation thereto. The block guide assembly 81 has a bottom plate 82 which is formed with guide-rod bores 91 communicating respectively with the cylindrical bores 39. Block guide elements 3 are accommodated respectively in the cylindrical bores 39. Each block guide element 3 has a cylindrical body whose top face is formed with a block guide 31, and whose bottom face is provided with a guide rod 33. The block guide elements 3 are arranged within the block guide assembly 81 in such a manner that the cylindrical body of the block guide element 3 is fitted in a corresponding one of the cylindrical bores 39, the block guide 31 is aligned with the block guide bore 38 associated with the cylindrical bore 39, and the guide rod 33 is aligned with the guide-rod bore 91 associated with the cylindrical bore 38. A slight gap is left between the top face of the cylindrical body of the block guide element 3 and the top face of the cylindrical bore 39 formed in the block guide assembly 81 or between the bottom face of the cylindrical body of the block guide element 3 and the inner surface of the bottom plate 82, so as to permit the block guide element 3 to be moved up and down in the cylindrical bore 39. The bottom plate 82 is bonded to the block guide assembly 81 by means of adhesive to prevent the block guide elements 3 from coming out of the respective cylindrical bores 39.

The control bores 83 formed in the control disc 87 are so positioned that selected ones of the guide rods 33 are fitted respectively in some of the control bores 83 in compliance with the degree of difficulty of the puzzle, to prevent the block guides 31 from projecting from the top face of the block guide assembly 81, i.e., the bottom surface of the block inlaying recess 22. That is, the control bores 83 located respectively at the guide rods 33 are reduced in number for a difficult puzzle pattern, while the control bores 83 located respectively at the guide rods 33 increases in number for an easy puzzle pattern.

The operation of the puzzle according to the eighth embodiment will next be described.

A player selects the degree of difficulty matched to his level, from the difficulty degree marks 84 printed on the side faces of the control disc 87. Subsequently, the control disc 87 is incorporated in the case 85 in such a manner that the selected difficulty degree mark 84 can be seen through the window 86. The block guide assembly 81 is then placed on the control disc 87.

If the control bores 83 in the control disc 87 exist below some of the guide rods 33 on the respective block guide elements 3, the some guide rods 33 are fitted respectively in the control bores 83, and the block guide elements 3 move downwardly under the gravity so that the cylindrical bodies of the respective block guide elements 3 are abutted against the inner surface of the bottom plate 82. Thus, the block guides 31 do not project from the bottom surface of the block inlaying recess 22. On the other hand, if the control bores 83 in the control disc 87 do not exist below some of the guide rods 33 on the respective block guide elements 3, the some guide rods 83 are abutted against the top face of the control disc 87 to prevent the block guide elements 3 from moving downwardly under the gravity so that the block guides 31 project from the bottom surface of the block inlaying recess 22. If the block guides 31 project from the bottom surface of the block inlaying recess 22, the block guides 31 serve as restrictions at the time the set of blocks 1D is inlaid in the block inlaying recess 22. On the other hand, if the block guides 31 do not project from the bottom surface of the block inlaying recess 22, the block guides 31 do not serve as restrictions at the time the set of blocks 1D is inlaid in the block inlaying recess 22. In this manner, the control disc 87 is altered in position in compliance with the degree of difficulty. The higher the degree of difficulty, the more the projecting block guides 31 increase in number so that it is made difficult to inlay the set of blocks 1D in the block inlaying recess 22. On the other hand, the lower the degree of difficulty, the more the projecting block guides 31 decrease in number so that it is made easy to inlay the set of blocks 1D in the block inlaying recess 22. Thus, the eighth embodiment also has advantages similar to those of the previously described first embodiment.

Figure 21:
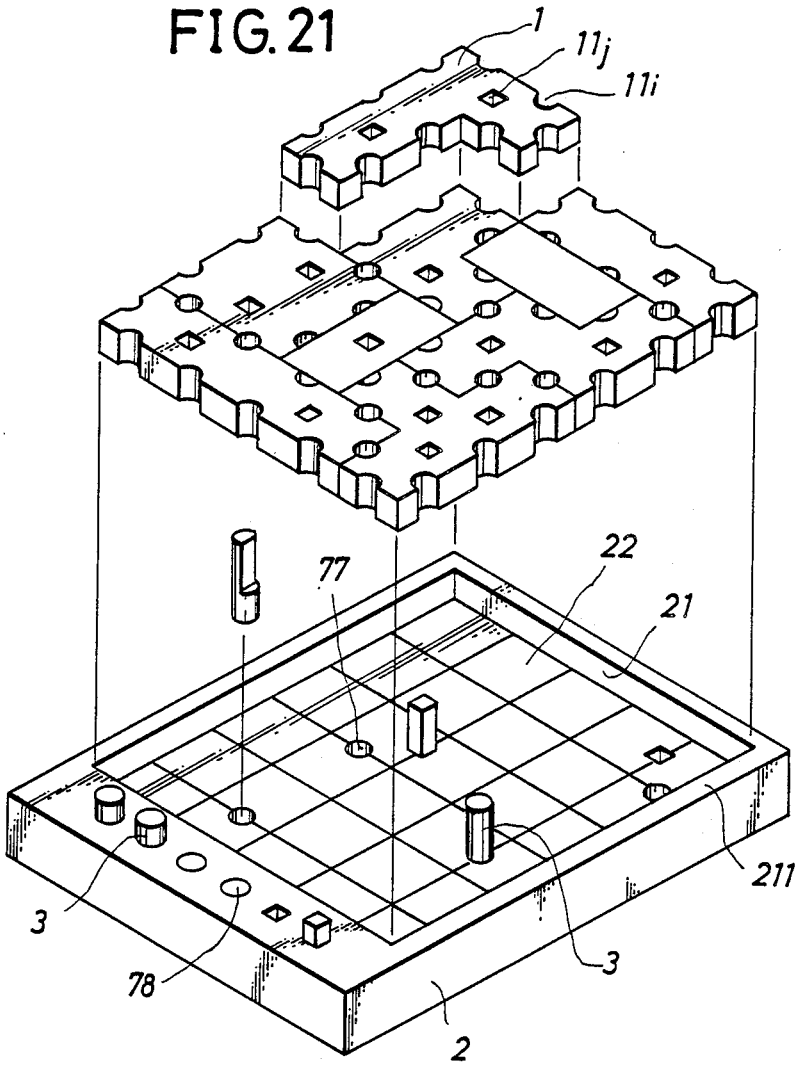
FIG. 21 is an exploded perspective view of a puzzle according to a ninth embodiment of the invention, in which block guide elements are detachably fitted respective in bores formed in a bottom surface of a block inlaying recess.

[Ninth Embodiment: FIG. 21]

FIG. 21 shows a puzzle according to a ninth embodiment of the invention. In the puzzle, each block 1E has a plan configuration in which two through four squares that are the basic shapes are assembled together. Each of some of the blocks 1E has sides each formed with one or more grooves 11*i* each of which has a semi-circular cross-sectional shape. Each of some of the blocks 1E is also provided at its center of the basic square with one or more bore 11*j* each having a rectangular cross-sectional shape.

A bottom surface of a block inlaying recess 22 in a puzzle board 2 is formed with a plurality of fixing bores 77 in which some of the block guide elements can be fitted respectively. The puzzle board 2 has a peripheral wall 211 which is provided with a plurality of accommodating bores 78 for accommodating the remaining block guide elements 3. The fixing bores 77 and the accommodating bores 78 have their respective cross-sectional shapes which include a circle and a square. The block guide elements 3 have their respective cross-sectional shapes which include a circle, a square, and a semi-circle in upper half and a circle in lower half. The block guide elements 3 have their respective lower halves which are adapted to be fitted in the fixing bores 77 and the accommodating bores 78.

The bottom surface of the block inlaying recess 22 has a configuration in which thirty squares consisting of five by six, that are the basic shapes, are assembled together.

The operation of the puzzle according to the ninth embodiment will next be described.

A player fixes some of the block guide elements 3 in the respective fixing bores 77, in compliance with the degree of difficulty matched to him. The remaining block guide elements 3 are inserted respectively into the accommodating bores 78. The set of blocks 1E is then inlaid in the block inlaying recess 22. At this time, the block guide elements 3 fitted respectively in the fixing bores 77 serve as restrictions at the time the set of blocks 1E is inlaid in the block inlaying recess 22. Thus, the puzzle according to the ninth embodiment has advantages similar to those of the previously described first embodiment.

Figure 22:
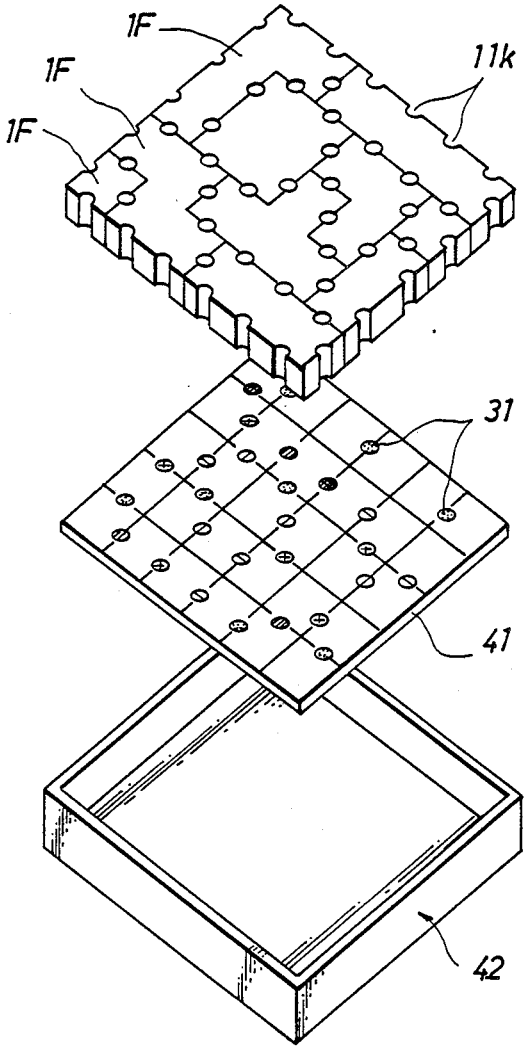
FIG. 22 is an exploded perspective view of a puzzle according to a tenth embodiment of the invention, employing a block guide plate on both sides of which block guides are printed in respective patterns different from each other.

[Tenth Embodiment: FIG. 22]

FIG. 22 shows a puzzle according to a tenth embodiment of the invention, which comprises a case 42. A bottom surface of the case 42 has a configuration in which thirty squares consisting of six by five, that are the basic shapes, are assembled together. The case 42 is provided with a peripheral wall 421.

A block guide plate 41 is adapted to be fitted in the case 42. The block guide plate 41 has an upper surface which cooperates with the peripheral wall 421 of the case 42 to define a block inlaying recess. A plurality of block guides 31 are printed on both sides of the block guide plate 41 such that each block guide 31 is located at a center of a side of the basic square. The arrangement of the block guides 31 on one side of the block guide plate 41 is different from that on the other side thereof. The block guides 31 are divided into six groups which are different in color from each other. Each group includes two through eight block guides 31.

Each block 1F has a plan configuration in which two through four squares that are the basic shapes are assembled together. Each block 1F has side faces each of which is provided with one or more grooves 11*k* each having a semi-circular cross-sectional shape, in order to enable the block guides 31 to be viewed through the grooves 11*k*.

The operation of the tenth embodiment will next be described.

A player selects one of the six color groups of block guides 31 in compliance with the degree of difficulty matched to his level. The set of blocks 1F is inlaid in the block inlaying recess in such a manner that the block guides 31 of the selected color group can be viewed through the grooves 11*k* in the blocks 1F, or in such a manner that the block guides 31 of the selected color group are concealed by the blocks 1F. When the set of blocks 1F is inlaid in the block inlaying recess in the manner described above, the block guides 31 serve as restrictions on the inlaying of the blocks 1F. Thus, the tenth embodiment has advantages similar to those of the previously described first embodiment.

Each block 1F used in the tenth embodiment may be one in which one or more bores are formed at a center of the basic square of the block as shown in FIGS. 9*d* and 9*f*. In this case, each block guide 31 is printed on the center of a corresponding one of some of the basic shapes forming the opposite sides of the block guide plate 41. Further, sections corresponding to the grooves 11*k* may be made transparent, in place of the provision of the grooves 11*k*. Furthermore, a plurality of block guide plates 41 different in type from each other may be incorporated in the case 42.

Figure 23:
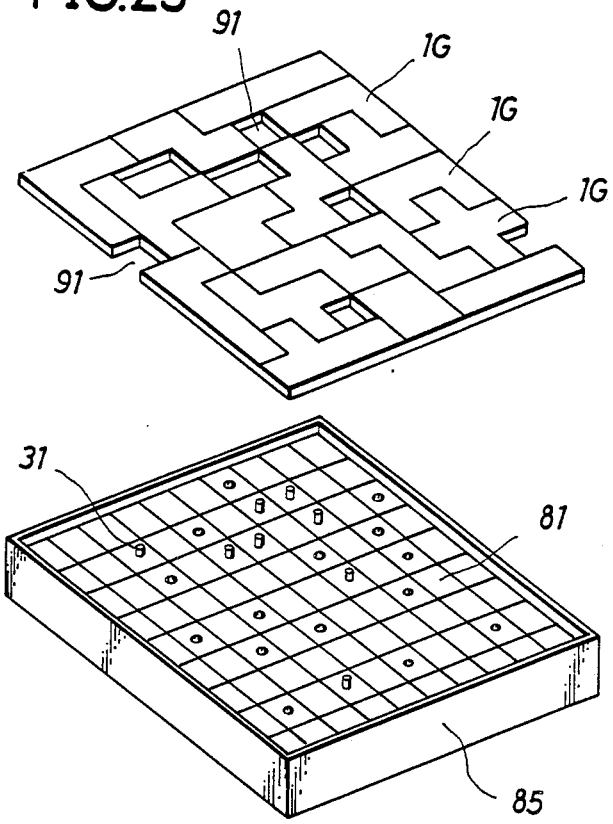
FIG. 23 is an exploded perspective view of a puzzle according to an eleventh embodiment of the invention, in which a set of blocks are inlaid in a block inlaying recess in such a manner that a predetermined number of openings is formed and that block guides on a block guide plate are located respectively in the openings.

[Eleventh Embodiment: FIG. 23]

FIG. 23 shows a puzzle according to an eleventh embodiment of the invention. In the puzzle, each block 1G has a plan configuration in which four or five squares that are the basic shapes are assembled together. Blocks 1G in a set are the same in configuration as those 1Aa through 1Aq shown in FIGS. 10*a* and 10*b*. The total number of the basic squares of the set of blocks 1G are eighty.

A bottom of a block inlaying recess 22 has a configuration in which ninety squares consisting of nine by ten, that are the basic shapes, are assembled together. Accordingly, when the set of blocks 1G are inlaid in the block inlaying recess 22, ten openings 91 are formed whose basic shapes are square.

Block guides 31 are located at centers of some of the basic squares which form the bottom surface of the block inlaying recess 22. The block guides 31 are so arranged as to be varied in number and arrangement pattern by an arrangement similar to that of the eighth embodiment illustrated in FIG. 19. The maximum number of the projecting block guides 31 is set to ten.

The operation of the eleventh embodiment will next be described.

A player sets the number and/or positions of the projecting block guides 31 in a manner like the eighth embodiment illustrated in FIG. 19, in compliance with the degree of difficulty matched to his level. If the number of the projecting block guides 31 is ten, the degree of difficulty of the puzzle is high, while if the number of the projecting block guides 31 is less than ten, the degree of difficulty of the puzzle is lowered.

Figure 24:
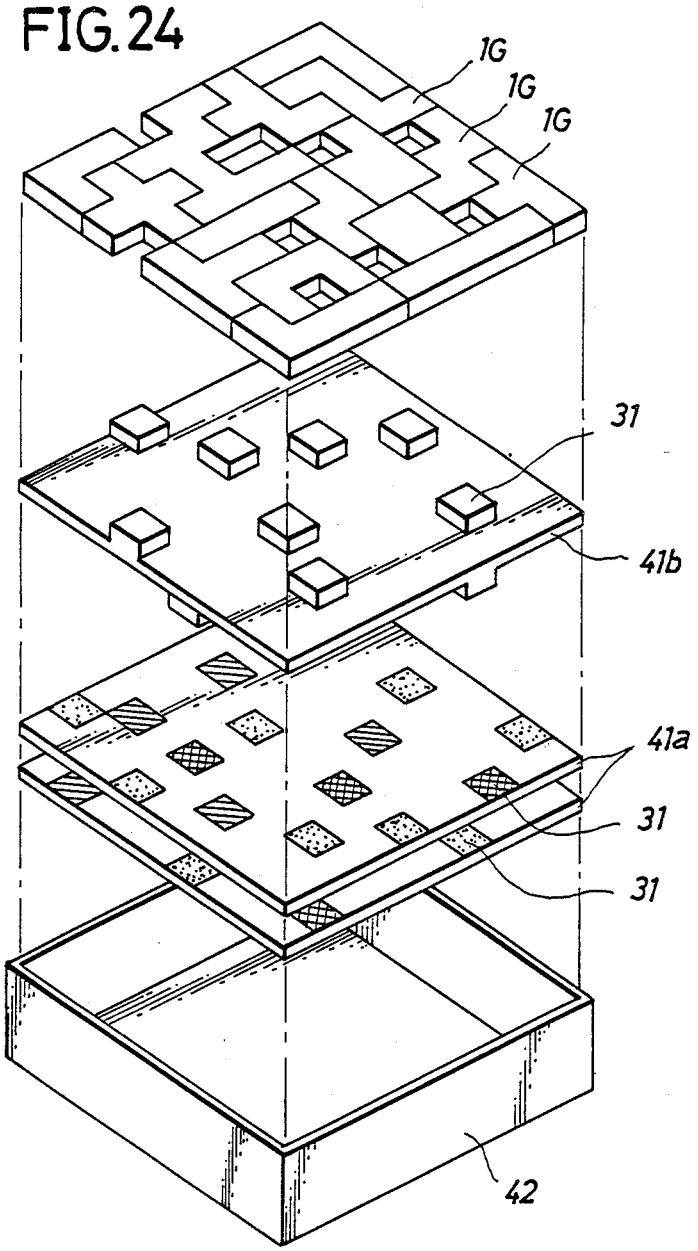
FIG. 24 is an exploded perspective view of a puzzle having modifications of the block guide plate illustrated in FIG. 23.

In connection with the above, each block guide 31 may have a plan configuration consisting of the basic shape of the blocks 1G, as shown in FIG. 24. In this case, the block guides 31 may be printed on each of the block guide plates 41*a*, or may project from the block guide plate 41*b*.

In the manner described above, the block guides 31 serve as restrictions at the time the set of blocks 1G is inlaid in the block inlaying recess 22. Thus, the eleventh embodiment also has advantages similar to those of the previously mentioned first embodiment.

Figure 25:
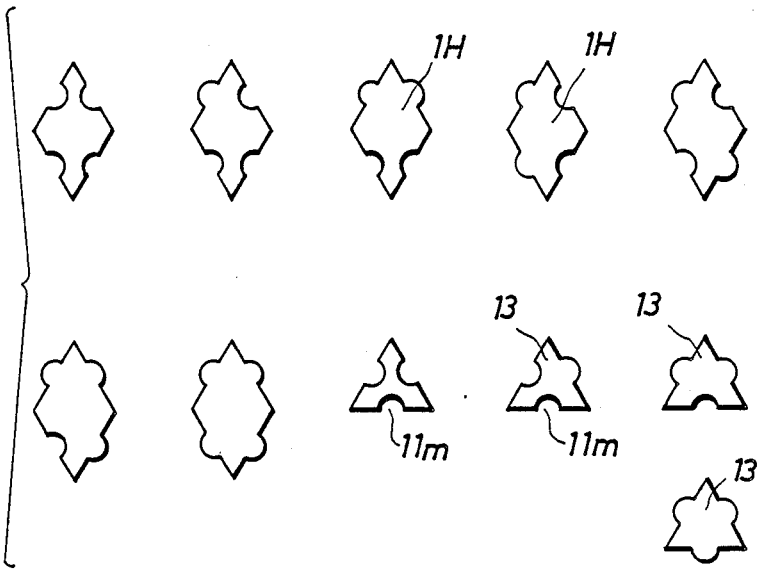
FIG. 25 is a plan view of a set of blocks employed in a puzzle according to a twelfth embodiment of the invention.
Figure 26:
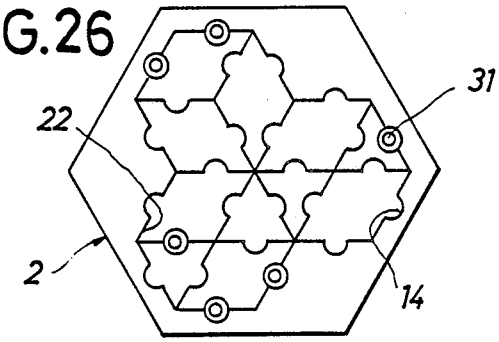
FIG. 26 is a plan view of a puzzle in which the blocks illustrated in FIG. 25 are inlaid in a block inlaying recess.

[Twelfth Embodiment: FIGS. 25 and 26]

Referring to FIGS. 25 and 26, there is shown a puzzle according to a twelfth embodiment of the invention. Each of blocks 1H in a set used in the puzzle has a plan configuration in which one or two regular triangles that are the basic shapes are assembled together, as shown in FIG. 25. An arcuate cut-out 11*m* or an arcuate projection 11*n* is formed in each of the sides of each block 11H at a location corresponding to a center of a side of the basic triangle. The arrangement is such that when the set of blocks 1H is inlaid in the block inlaying recess 22 as shown in FIG. 26, the projections 13 are fitted respectively in the cut-outs 11*m*.

The bottom surface of the block inlaying recess 22 formed in the puzzle board 2 has a configuration in which eighteen regular triangles that are the basis shapes are assembled together. By an arrangement like that of the first embodiment shown in FIGS. 1*a* through 7, the block guides 31 can be moved between the extended position where the block guides 31 project from the bottom surface of the block inlaying recess 22 and the retracted position where the block guides 31 are concealed below the bottom surface of the block inlaying recess 22. Only six block guides 31 are shown in FIG. 26, but a few block guides 31 are concealed below the projections 13 on some of the block guides 31. The arrangement is such that the number and/or positions of the projecting block guides 31 are varied by intermittent rotation of a block-guide moving disc like that shown in FIGS. 4 and 5. The maximum number of the projecting block guides 31 is set to six. The peripheral wall surface 21 of the block inlaying recess 22 is formed with recesses 14 identical in configuration with the projections 13.

The operation of the twelfth embodiment will next be described.

A player sets the number and/or positions of the projecting block guides 31 in a manner like that of the first embodiment, in compliance with the degree of difficulty matched to his level. If the number of the projecting block guides 31 is six, the degree of difficulty of the puzzle is high, while if the number of the projecting block guides 31 is less than six, the degree of difficulty of the puzzle is lowered.

Figure 27:
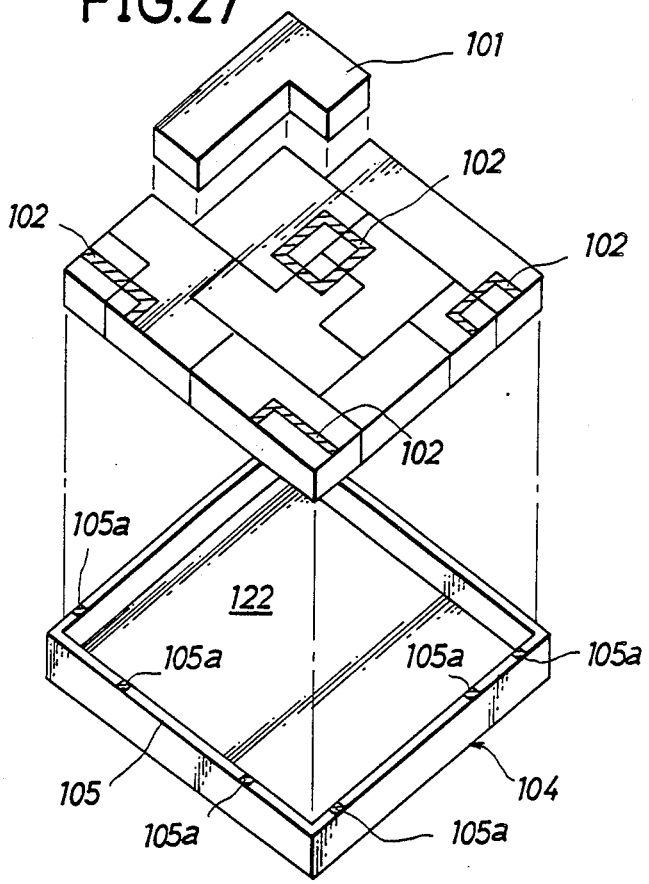
FIG. 27 is an exploded perspective view of a puzzle according to a thirteenth embodiment of the invention, in which block guides are printed on selected ones of a set of blocks.

[Thirteenth Embodiment: FIG. 27]

Referring to FIG. 27, there is shown a puzzle according to a thirteenth embodiment of the invention, which utilizes a set of blocks 101. Each block 101 has a plan configuration in which one through four squares that are the basic shapes are assembled together. Almost all of the blocks 101 are different in configuration from each other. A mark 102 is printed on one or both sides of some of the blocks 101. Each mark 102 is formed by a thick line which connects a center of a side of the basic shape of the block 101 to a center of another side of the basic shape.

A bottom surface of a block inlaying recess 122 formed in a puzzle board 104 has a configuration in which thirty squares consisting of five by six, that are the basic shapes, are assembled together. The puzzle board 104 is provided with an outer peripheral wall 105 whose height is substantially equal to the thickness of each block 101. Marks 105*a* each of which has a width equal to that of the mark 102 on the block 101 are printed on the top face of the outer peripheral wall 105.

The operation of the puzzle constructed as above according to the thirteenth embodiment will be described.

Since the sum of the basic shapes of the respective blocks 101 is the same as the number of the basic shapes forming the bottom surface of the block inlaying recess 122, all of the set of blocks 101 can be inlaid in the block inlaying recess 122. The marks 102 are printed on some of the blocks 101, and the marks 105*a* are printed on the top face of the peripheral wall 105 of the puzzle board 104. The set of blocks 101 is required to be inlaid in the block inlaying recess 22 in such a manner that the marks 102 and 105*a* are connected to each other. Thus, the marks 102 and 105*a* serve as restricting conditions under which the set of blocks 101 is inlaid in the block inlaying recess 122.

The degree of difficulty of the puzzle is low if the set of blocks 101 is merely inlaid in the block inlaying recess 122 without being subject to the restricting condition that the set of blocks 101 must be inlaid in the block inlaying recess 122 in such a manner that the marks 102 printed on the blocks 101 and the marks 105*a* printed on the top face of the peripheral wall 105 of the puzzle board 104 are all connected to each other. Inlaying of the set of the puzzles 101 in the block inlaying recess 122 in such a manner that the marks 102 on the blocks 101 and the marks 105*a* on the top face of the peripheral wall 105 of the puzzle board 104 are all connected to each other, raises the degree of difficulty of the puzzle, because the marks 102 and 105*a* serve as restrictions. In this manner, it is possible for the puzzle to obtain various puzzle patterns different in degree of difficulty from each other, by a single puzzle.

In the thirteenth embodiment, the set of blocks 101 may include two or more blocks identical in plan configuration with each other. Also in this case, the advantages are the same. Further, the total number of the basic shapes of the respective blocks 101 may be less than the number of the basic shapes forming the bottom surface of the block inlaying recess 122. In this case, the restricting conditions at the time the set of blocks 101 is inlaid in the block inlaying recess 122 are relaxed so that the puzzle is made easy.

Figure 28A:
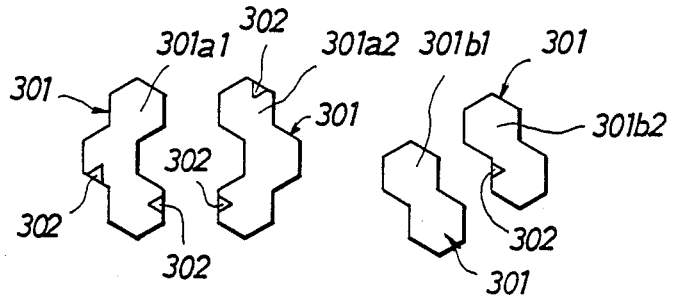
FIG. 28*a* is a plan view of some of a set of blocks employed in a puzzle according to a fourteenth embodiment of the invention.
Figure 28B:
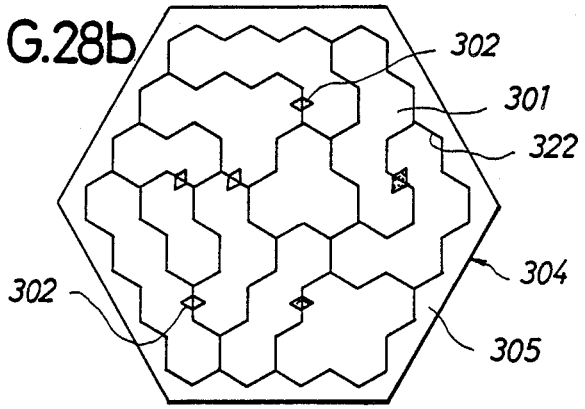
FIG. 28*b* is a plan view of the puzzle in which the blocks illustrated in FIGS. 28*a* are inlaid in a block inlaying recess.
Figure 28C:
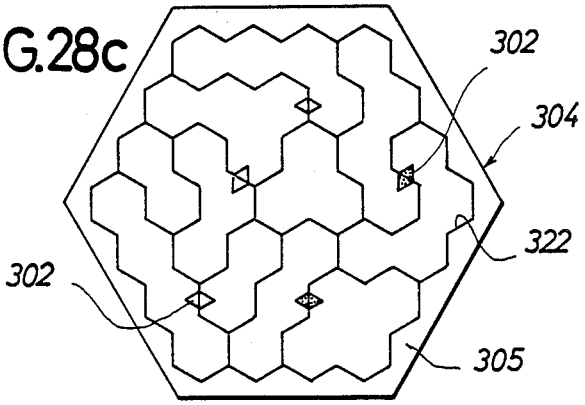
FIG. 28*c* is a view similar to FIG. 28*b*, but showing another inlaying pattern of the blocks illustrated in FIG. 28*a;*

[Fourteenth Embodiment: FIGS. 28*a* through 28*c*]

A puzzle according to a fourteenth embodiment will be described with reference to FIGS. 28*a* through 28*c*. The basic shape of the puzzle is a regular hexagon. Each of blocks 301 in a set has a plan configuration in which two through four regular hexagons that are the basic shapes are assembled together. A mark 302 is printed on a center of a side of one or more basic hexagons of some of the blocks 101. The positions of the marks 302 on the front face 301*a*l of the block 301 are different from those on the back face 301*a*2 thereof as shown in FIG. 28*a*. Alternatively, the number of the marks 302 on the front face 301*b*1 of the block 301 is different from that on the back face 301*b*2 thereof.

A bottom surface of a block inlaying recess 322 formed in a puzzle board 304 has a configuration in which thirty-seven regular hexagons that are the basic shapes are assembled together. The puzzle board 304 is provided with an outer peripheral wall 305 whose height is substantially equal to the thickness of each block 301.

The puzzle constructed as above is played as follows. That is, the set of blocks 301 is inlaid in the block inlaying recess 322 without being subject to the restrictions of the marks 302. Alternatively, the set of blocks 301 is inlaid in the block inlaying recess 322 in such a manner that the mark 302 on one block is located adjacent the mark 302 on another block.

The puzzle is made easy if the set of blocks 301 is inlaid in the block inlaying recess 322 without being subject to the restrictions of the marks 302. On the other hand, the puzzle is made difficult if the set of blocks 301 is inlaid in the block inlaying recess 322 in such a manner that the marks 302 are located adjacent to each other.

Further, since the positions of the marks 301*a*1 on the front face of the block are different from those on the back face thereof as shown in FIG. 28*a*, there is provided a puzzle rich in variation if reversed some of the set of blocks 301 are inlaid in the block inlaying recess 322. Moreover, since the number of the marks 302 on the front face 301*b*1 of the block is different from that on the back face 301*b*2 thereof, the degree of difficulty of the puzzle is further raised if inverted some of the set of blocks 301 are inlaid in the block inlaying recess 322 such that the marks 302 increase in number.

While selecting the front faces and the back faces of the blocks 301, a player plays the puzzle in order from a puzzle pattern of the blocks 301 which is less in number of the sets of adjoining marks 302, to a puzzle pattern of the blocks 301 which is many in number of the sets of adjoining marks 302. Thus, the player can challenge the puzzle patterns which rise in the degree of difficulty gradually.

It is possible also for the fourteenth embodiment to provide a single puzzle with various puzzle patterns different in degree of difficulty from each other, like the previously described first embodiment. Further, it is needless to say that the invention can be put into practice if the basic shape is a square.

Figure 29:
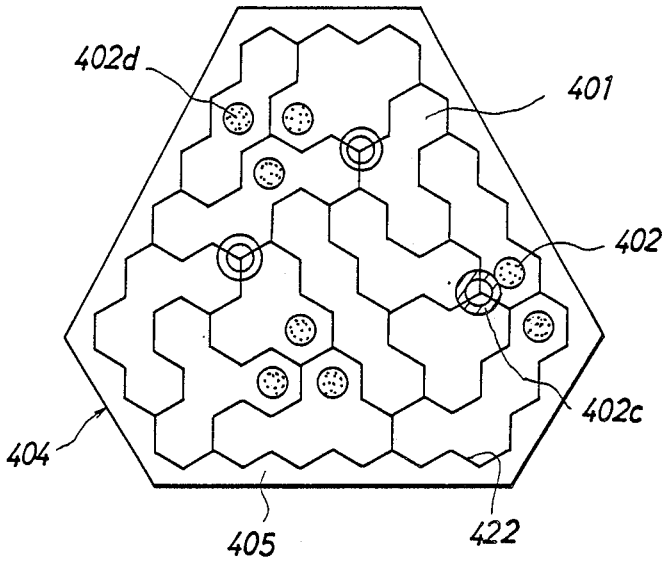
FIG. 29 is a plan view of a puzzle according to a fifteenth embodiment of the invention.

[Fifteenth Embodiment: FIG. 29]

Referring to FIG. 29, there is shown a puzzle according to a fifteenth embodiment of the invention, which well resembles the puzzle according to the fourteenth embodiment shown in FIGS. 28*a* through 28*c*. The puzzle according to the fifteenth embodiment is different from that according to the fourteenth embodiment in the positions of the marks printed on the blocks. Specifically, each mark 402*c* is located at an apex of the basic hexagon, while each mark 402*d* is located at a center of the basic hexagon.

In the previous fourteenth embodiment, each pair of marks 302 are required to coincide with each other. On the other hand, in the fifteenth embodiment, three marks 402*c* in a set are required to coincide with each other. Further, two or three marks 402*d* in a set are required to coincide with each other. In this manner, each of the marks 402 may be located at a position other than the center of the side of the basic shape.

It is possible also for the fifteenth embodiment to provide a single puzzle with various puzzle patterns different in degree of difficulty from each other, like the previously described first embodiment.

Figure 30A:
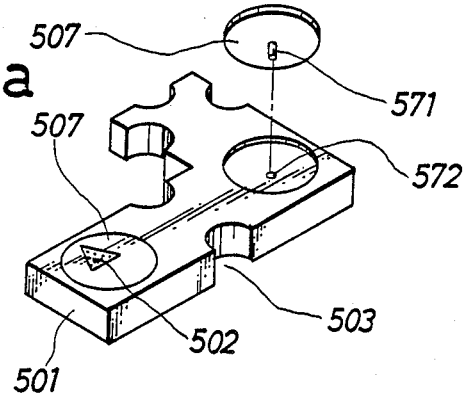
FIG. 30*a* is a perspective view of one of a set of blocks used in a puzzle according to a sixteenth embodiment of the invention.
Figure 30A:
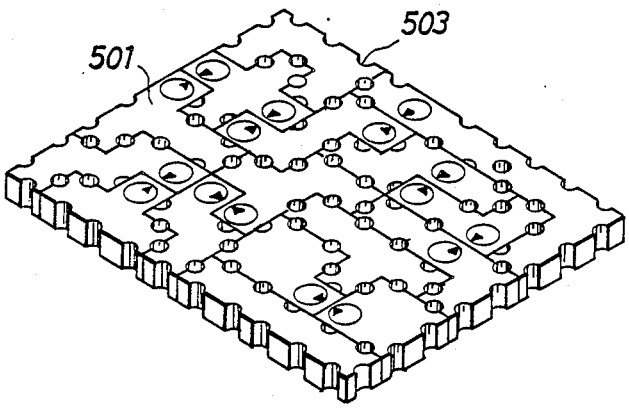
Figure 30B:
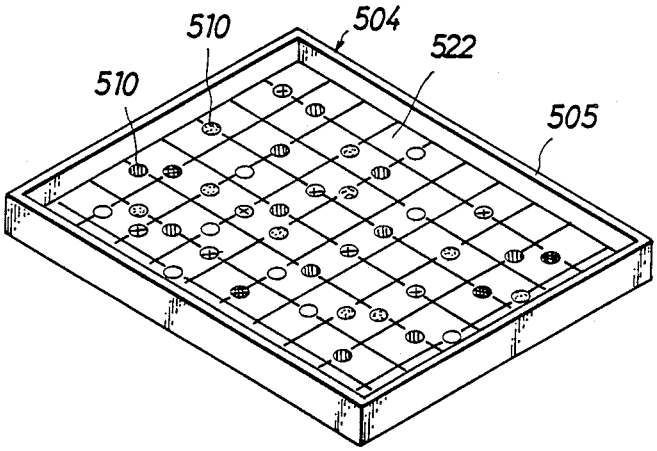
FIG. 30*b* is an exploded perspective view of the puzzle in which the blocks illustrated in FIG. 30*a* are inlaid in a block inlaying recess.

[Sixteenth Embodiment: FIGS. 30*a* and 30*b*]

A puzzle according to a sixteenth embodiment will be described with reference to FIGS. 30*a* and 30*b*.

As shown in FIG. 30*a*, a rotary disc 507 has a back face which is provided at its center with a projecting disc shaft 571. A mark 502 is printed on a front face of the rotary disc 507. One or more rotary discs 507 are mounted to each of some of a set of blocks 501, with the disc shaft 571 fitted in a shaft bore 572 in the block 501, so that the rotary disc 507 is rotatable about the axis of the disc shaft 571. Since the rotary disc 507 is rotatably mounted to the block 501, it is possible to alter the position or orientation of the mark 502.

A bottom surface of a block inlaying recess 522 in a puzzle board 504 has a configuration in which eighty squares consisting of eight by ten, that are the basic shapes, are assembled together. A block guide 510 is printed at a center of a side of each of some of the basic shapes forming the bottom surface of the block inlaying recess 522. The block guides 510 are divided into a plurality of groups different in color from each other. For instance, the first group includes ten red block guides, the second group includes five blue block guides, and the third group includes nine yellow block guides.

A groove 503 having a semi-circular cross-sectional shape is formed at a center of a side of each of some of the basic shapes forming each block 501. The arrangement is such that when the set of blocks 501 is inlaid in the block inlaying recess 522, some of the block guides 510 can be viewed through the grooves 503.

The puzzle constructed as above according to the sixteenth embodiment can obtain the following three restrictions at the time the set of blocks 501 is inlaid in the block inlaying recess 522:

First Restriction:

To inlay the set of blocks 501 in the block inlaying recess 522;

Second Restriction:

To bring the marks 502 on the adjacent blocks 501 into coincidence with each other; and Third Restriction:

To enable the block guides 510 in the specific color group applied to the bottom surface of the block inlaying recess 522, to be viewed through the grooves 503 in the inlaid set of blocks 501.

As described above, the sixteenth embodiment has also advantages similar to those of the previously described first embodiment. In addition, there is provided additional restricting conditions that are the marks 502 on the rotary discs 507, when the set of the blocks 501 is inlaid in the block inlaying recess 522. Thus, it is possible to enhance the fun or amusement. Furthermore, since it is possible to alter the positions or orientations of the marks 502 on the blocks, a player can play the puzzle while creating new puzzle patterns.

For instance, when the player plays the puzzle alone, he alters the positions of the marks 502 to set a problem by himself so that he can play the puzzle while creating totally new puzzle pattern. Since, in this manner, the player can freely set the level of the problem as he likes, there is less possibility that he gets tired of the puzzle.

When two players play the puzzle, one of them can give a problem to the other so that they can have a conversation with each other through the puzzle. If the two players are parent and child, the parent can set the problem in compliance with the ability of the child. If the two players are friends, they can play the puzzle in such a manner that one of them gives a problem to the other and they compete with each other in solving the puzzle quickly.

When the players are more than three, one selects the positions of the marks 502 to give a problem, and the remaining two can play the puzzle in competition with each other in solving the puzzle quickly.

Figure 31A:
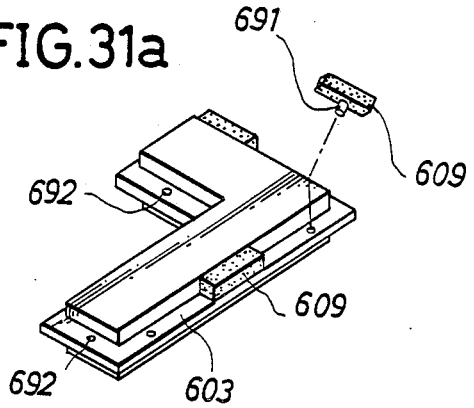
FIG. 31*a* is a perspective view of one of a set of blocks employed in a puzzle according to a seventeenth embodiment of the invention.
Figure 31B:
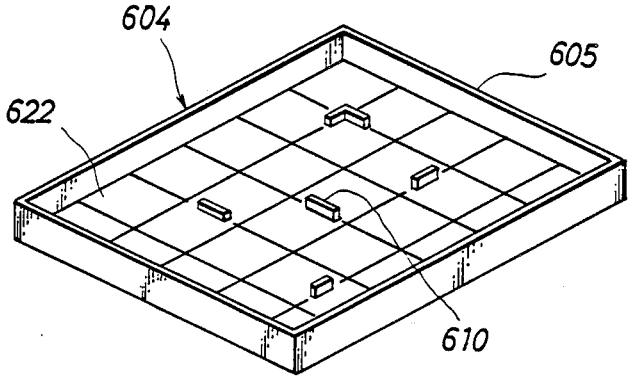
FIG. 31*b* is a perspective view of a puzzle board provided with a block inlaying recess in which the blocks illustrated in FIG. 31*a* are inlaid.

[Seventeenth Embodiment: FIGS. 31*a* and 31*b*]

A puzzle according to a seventh embodiment of the invention will be described with reference to FIGS. 31*a* and 31*b*.

Each of blocks 601 in a set has a plan configuration in which one through four squares that are the basic shapes are assembled together, like the thirteenth embodiment. Each block 601 has opposite faces provided respectively with peripheral steps 603. The step 603 is provided with a plurality of bores 692 each of which is located in the vicinity of a center of a side of the basic square.

Mark pieces 609 each in the form of a rectangular-parallelepipedic rod can partially be fitted on the step 603. A projection 691 is provided at a center of a lower surface of each mark piece 609. The projection 691 can be fitted in the bore 692 so that the mark piece 609 is removably or detachably mounted to the block 601.

A bottom surface of a block inlaying recess 622 in a puzzle board 604 has a configuration in which thirty squares consisting of five by six, that are the basic shapes, are assembled together. In addition, the puzzle board 604 is provided with an outer peripheral wall 605. A plurality of block guides 610 each in the form of a flat plate are fixedly mounted to the bottom surface of the block inlaying recess 622 at locations corresponding to the sides and the apex of some of the basic squares. Each block guide 610 has a configuration capable of being fitted in the step 603 in the block 601. The block guides 610 serve as restrictions at the time the set of blocks 601 is inlaid in the block inlaying recess 622.

The seventeenth embodiment can also have various puzzle patterns different in degree of difficulty from each other by a single puzzle, similarly to the previously described first embodiment. Further, the seventeenth embodiment has the previously mentioned three restricting conditions in inlaying of the set of the blocks 601 in the block inlaying recess 622, similarly to the sixteenth embodiment. A player can play the puzzle while creating new puzzle patterns by altering the positions of the mark pieces 609.

Figure 32A:
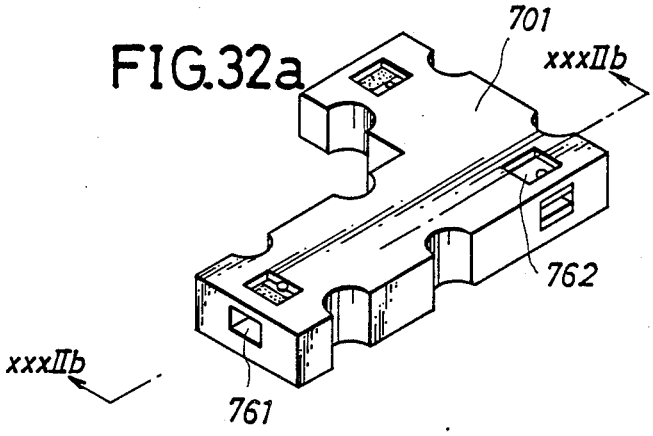
FIG. 32*a* is a perspective view of one of a set of blocks used in a puzzle according to an eighteenth embodiment of the invention.
Figure 32B:
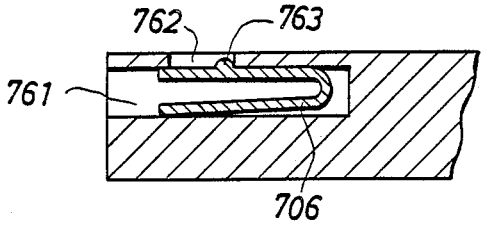
FIG. 32*b* is a fragmentary cross-sectional view taken along the line XXXIIb—XXXIIb in FIG. 32*a*.
Figure 32C:
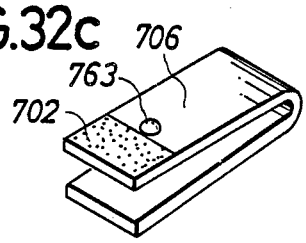
FIG. 32*c* is a perspective view of a removable mark piece illustrated in FIG. 32*b*.

[Eighteenth Embodiment: FIGS. 32*a* through 32*c*]

A puzzle according to an eighteenth embodiment will be described with reference to FIGS. 32*a* through 32*c*.

A basic shape of blocks 701 in a set used in the eighteenth embodiment is the same as that of the thirteenth embodiment shown in FIG. 27. That is, each block 701 has a plan configuration in which one through 4 squares that are the basic shapes are assembled together. Almost all of the blocks 701 in the set are different in configuration from each other.

Each block 701 is provided in its side faces will bores 761 in which U-shaped mark pieces 706 are slidably fitted respectively. The block 701 is formed at its front face with a plurality of windows 762 communicating respectively with the bores 761 so that marks 702 on the respective mark pieces 706 can be viewed through the respective windows 762. Each mark piece 706 is provided on its upper face with a projection 763 which can be abutted against an edge of the window 762 thereby restricting movement of the mark piece 706. The mark piece 706 can move slidingly in the bore 761 between a position where the mark 702 on the mark piece 706 is viewed through the window 762 and a position where the mark 702 on the mark piece 706 is concealed by the wall of the bore 761.

The bottom surface of the block inlaying recess in the puzzle board used in the eighteenth embodiment shown in FIGS. 32*a* through 32*c* is the same in configuration as that of the thirteenth embodiment.

The eighteenth embodiment can also have various puzzle patterns different in degree of difficulty from each other by a single puzzle, similarly to the previously described first embodiment. Further, the eighteenth embodiment can have the aforementioned three restricting conditions in inlaying of the set of blocks in the block inlaying recess, similarly to the sixteenth embodiment. Thus, a player can play the puzzle while creating new puzzle patterns by altering the positions of the marks 702.

In each of the thirteenth through eighteenth embodiments, the puzzle is made easy if the set of blocks is merely inlaid in the block inlaying recess. On the other hand, the puzzle is made difficult if the set of blocks is inlaid in the block inlaying recess in such a manner that the marks on the blocks are brought into coincidence with each other, because additional restricting condition is produced. The more the number of sets of the marks to be brought into coincidence with each other, the higher the degree of difficulty of the puzzle is raised.

Each of the above-described sixteenth through eighteenth embodiments can have the following three restricting conditions in inlaying of the set of blocks in the block inlaying recess:

First Restriction:

To inlay the set of blocks in the block inlaying recess;

Second Restriction:

To bring the marks on the adjacent blocks into coincidence with each other; and

Third Restriction:

To inlay the set of blocks in the block inlaying recess under the restrictions of the block guides applied to the bottom surface of the block inlaying recess.

The basic shape utilized in the invention has been described as being a regular triangle, a square or a regular hexagon. It is to be noted, however, the basic shape may be any one if it is used in block inlaying puzzles of the kind referred to above. For instance, the basic shape may be one in which arcs project from a circle at intervals of sixty degrees. Further, the block guides may be any ones if they can provide restrictions in inlaying of a set of blocks in a block inlaying recess.

Furthermore, in the invention, any two or more of the means for moving the block guides between the extended position and the retracted position, the configuration of the block inlaying recess, the configuration of each of the blocks in a set, and the configuration of each block guide may be combined with each other. For example, the block guides shown in FIG. 14 or 21 may be combined with each of the puzzle boards illustrated respectively in FIGS. 11*a* through 11*c* and FIG. 13. Further, the blocks shown in FIGS. 10*a* and 10*b* may be combined with those shown in FIG. 14.

As described above, in the invention, since the block guides are provided on the bottom surface of the block inlaying recess and/or on the blocks, there are extremely large number of combinations among the configuration of the bottom surface of the block inlaying recess, the configuration of each of the blocks in a set, the number of the block guides, and the positions of the block guides. Thus, there is provided a puzzle which is rich in variation in inlaying of the set of blocks in the block inlaying recess.

Particularly, in case where the arrangement is such that the block guides can be moved between the extended position and the retracted position, it is possible to provide a single puzzle board with a plurality of puzzle patterns different in degree of difficulty from each other. Accordingly, once a player overcomes one block-inlaying pattern, he can challenge new block-inlaying pattern different in degree of difficulty from the previous one, by varying the number of block guides occupying the extended position and/or the arrangement pattern of the block guides. Thus, there can be provided a puzzle rich in interest.

Further, since the puzzle is brought to an easy puzzle pattern by altering the degree of block-inlaying difficulty, the puzzle can be brought to one matched to a player low in block-inlaying ability. If the puzzle is brought to a difficult puzzle pattern by altering the degree of block-inlaying difficulty, the puzzle can be brought to one matched to a player high in block-inlaying ability. Thus, there can be provided a puzzle rich in interest, which can be matched to various players different in ability from each other.

Moreover, a player who is fast in progress, particularly, a child can enjoy a puzzle pattern in conformity with his progress in ability, with a single puzzle.

Furthermore, each of various players different in ability from each other can enjoy a puzzle pattern in conformity with his ability by varying the degree of difficulty of a single puzzle. Thus, the puzzle is advantageous also from the economic point of view.

What is claimed is:

1. A block inlaying puzzle comprising:

a set of a plurality of blocks each having a plan configuration consisting of at least one basic shape;

a puzzle board provided with a block inlaying recess having a bottom surface and a peripheral wall surface surrounding a periphery of said bottom surface, said bottom surface having a configuration in which a plurality of said basic shapes are assembled together; and restricting means arranged on said bottom surface of said block inlaying recess for imposing restrictions on inlaying of said set of blocks in said block inlaying recess wherein said restricting means comprises a plurality of block guides arranged on said bottom surface of said block inlaying recess; and further comprising block-guide moving means for moving said block guides between a retracted position below said bottom surface of said block inlaying recess and an extended position where said block guides project from said bottom surface of said block inlaying recess.

2. A block inlaying puzzle according to claim 1, including a plurality of block guide elements, each of said block guide element having a cylindrical body and a guide rod projecting from one end of said cylindrical body, wherein said block guides are provided respectively on the other ends of the cylindrical bodies of the respective block guide elements, wherein said puzzle board has a plurality of guide bores formed in said bottom surface of said block inlaying recess, and cylindrical bores communicating respectively with said guide bores, said block guides being fitted respectively in said guide bores, said cylindrical bodies being fitted respectively in said cylindrical bores for movement along axes of the respective cylindrical bores, wherein said block-guide moving means has a block-guide moving disc rotatably mounted to said puzzle board, said block-guide moving disc being formed with at least one circular cam groove having shallow sections and deep sections arranged at random, said guide rods being fitted in said cam groove, and wherein said block-guide moving disc is rotated relatively to said puzzle board to move said block guides between said extended position and said retracted position.

* * * * *